US007726479B2

(12) United States Patent
Vasudeva

(10) Patent No.: US 7,726,479 B2
(45) Date of Patent: Jun. 1, 2010

(54) TOOL CASES WITH EASY REMOVAL OF STORED ITEMS

(75) Inventor: Kailash C. Vasudeva, Waterloo (CA)

(73) Assignee: Team Fair Holdings Limited, Road Town, VA (US)

( * ) Notice: Subject to any disclaimer, the term of this patent is extended or adjusted under 35 U.S.C. 154(b) by 63 days.

(21) Appl. No.: 10/188,830

(22) Filed: Jul. 5, 2002

(65) Prior Publication Data

US 2003/0006157 A1 Jan. 9, 2003

Related U.S. Application Data

(60) Provisional application No. 60/302,704, filed on Jul. 5, 2001.

(51) Int. Cl.
*B65D 85/20* (2006.01)

(52) U.S. Cl. ..... 206/379; 206/373

(58) Field of Classification Search ..... 206/372, 206/373, 379, 349, 564, 443, 486
See application file for complete search history.

(56) References Cited

U.S. PATENT DOCUMENTS

| | | | | | |
|---|---|---|---|---|---|
| 935,420 | A * | 9/1909 | Smith | 206/564 |
| 1,822,070 | A * | 9/1931 | Vallone | 206/373 |
| 2,792,934 | A * | 5/1957 | Rocchetti | 206/379 |
| 2,844,244 | A * | 7/1958 | Hanson | 206/379 |
| 3,236,366 | A | 2/1966 | Broda et al. | |
| 3,367,483 | A * | 2/1968 | Studen | 206/379 |
| 3,578,153 | A | 5/1971 | Olson | |
| 3,804,238 | A * | 4/1974 | Howard | 206/372 |
| 3,923,152 | A * | 12/1975 | Minneman | 206/372 |
| 4,660,719 | A | 4/1987 | Peterson et al. | |
| 5,758,769 | A * | 6/1998 | Vasudeva | 206/372 |
| 5,803,254 | A * | 9/1998 | Vasudeva | 206/373 |
| 5,893,457 | A | 4/1999 | Wei | |
| 6,105,770 | A | 8/2000 | Vasudeva | |
| 6,283,291 | B1 | 9/2001 | Vasudeva et al. | |
| 6,681,933 | B1 * | 1/2004 | Demsien et al. | 206/443 |

FOREIGN PATENT DOCUMENTS

WO WO 03/004220 A1 * 1/2003

* cited by examiner

*Primary Examiner*—J. Gregory Pickett
(74) *Attorney, Agent, or Firm*—Borden Ladner Gervais LLP; Jeffrey W. Wong

(57) ABSTRACT

A tool case has a lid and a base, and a panel arranged therebetween. Various structures are used to trap or otherwise retain tools, tool items or other stored items, such that they cannot accidentally fall out of their "home" positions, but such that they are readily removable by the user when desired. Such structures include, for example, retractable stops, depressions beneath stored items, weight-biased pivoting of holders, spring biasing of holders, trapping of items by the lid or by other item holders within the case, and various clip arrangements. Preferably the lid is transparent, and the tools or other items are arranged by height in step-wise fashion, the panel being stepped accordingly, to maximize visibility.

9 Claims, 25 Drawing Sheets

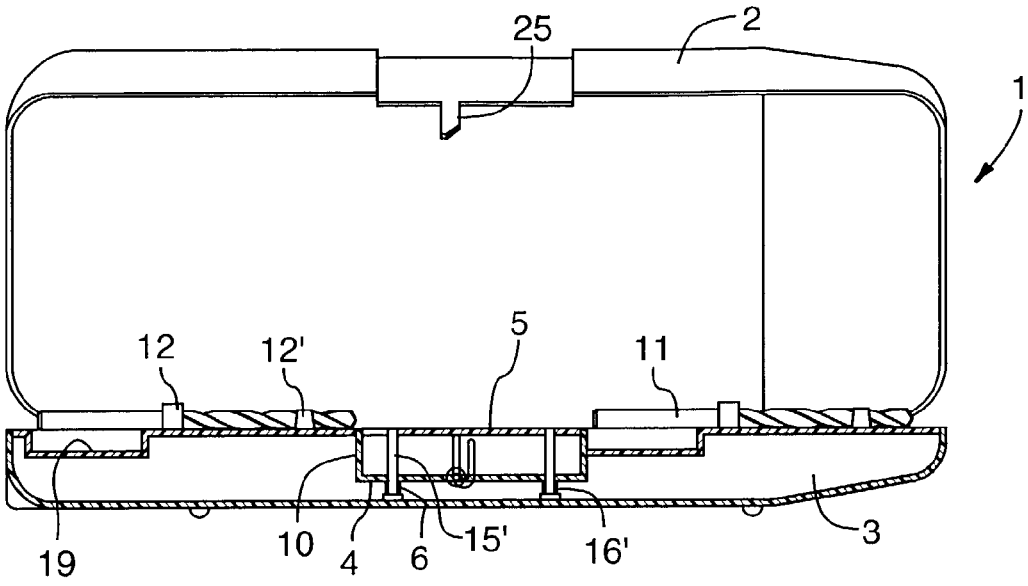
FIG.7A
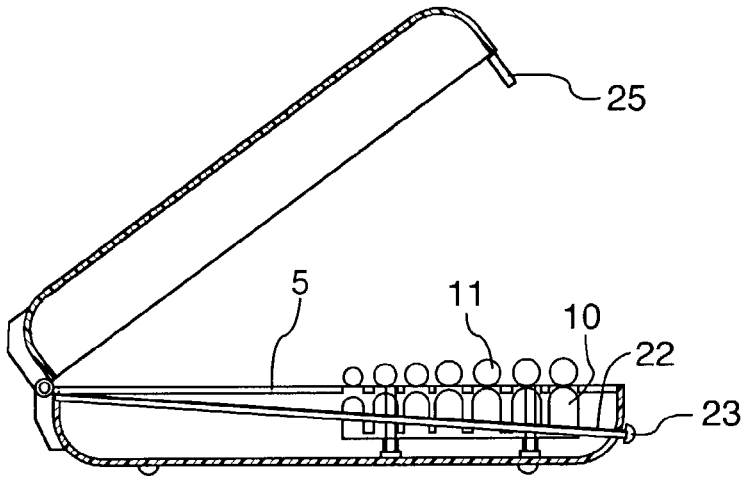
FIG.7B
FIG.7C
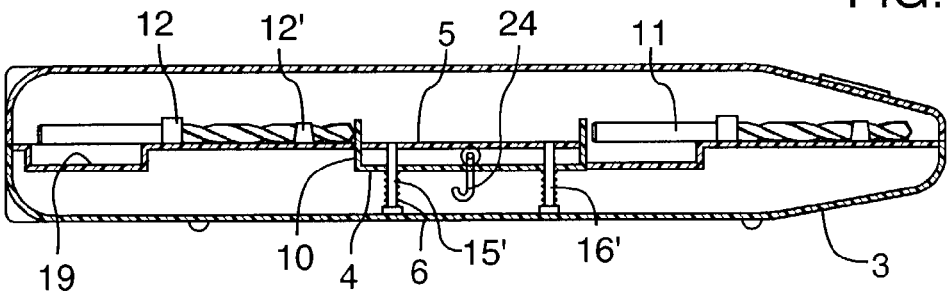
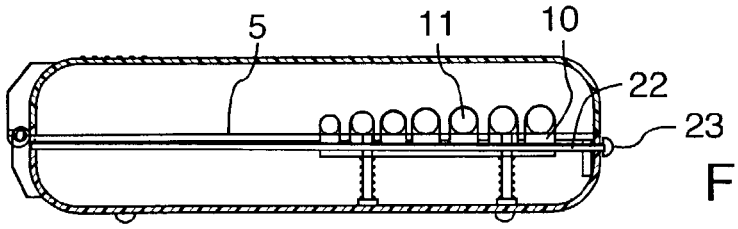
FIG.7D

TOOL CASES WITH EASY REMOVAL OF STORED ITEMS

REFERENCE TO RELATED APPLICATION

This is a formal application based on and claiming the benefit of U.S. provisional patent application No. 60/302,704, filed on Jul. 5, 2001.

BACKGROUND OF THE INVENTION

This invention relates to tool cases, particularly those which hold a variety of items, and particularly to features which provide easy access to those items.

It is common to store tools, tool bits, drill bits or other items in tool cases, usually by some sort of snap-in arrangement or similar. Because the stored items generally must be somehow secured so that they do not accidentally move around within the case or fall out of the case when the case is opened, the stored items are often difficult to remove.

SUMMARY OF THE INVENTION

It is an object of the invention to improve on existing tool cases and provide tool cases and tool case features which facilitate secure storage and yet easy removal of stored items.

In the invention, a tool case has a lid and a base, and a panel arranged therebetween. Various means are used to trap or otherwise retain tools, tool components or other stored items, such that they cannot accidentally fall out of their "home" positions, but such that they are readily removable by the user when desired. Such means include, for example, retractable stops, depressions beneath stored items, weight-biased pivoting of holders, spring biasing of holders, trapping of components by the lid or by other component holders within the case, and various clip arrangements, the preceding being exemplary only, and not limiting.

In one embodiment, a stop plate is mounted between the panel and the base and is biased towards the base. The stop plate is movable between an access position, in which the stop plate is moved towards the base, and a holding position, in which the stop plate is moved towards the panel. The stop plate further may have at least one finger, which protrudes through at least one corresponding slot in the panel when the stop plate is in the holding position and which is retracted through the slot when the stop plate is in the access position. The finger serves as a stop for a component held on the panel when the stop plate is in the holding position.

In a variation, a lever is preferably pivotably connected to a side of the base and extends across the stop plate and protrudes through an opposite side of the base via a J-shaped opening providing a manual means to raise and lower the stop plate, so that when the lid is open, an end of the lever is pushed along the J slot and inserted in a short end of the opening to thereby retain the lever and lowering the stop plate and the fingers making the components easily accessible, and when the lid is closed, a tapered projection on an edge of the lid urges the lever out of the short end of the opening and the stop plate is biased towards the lid, causing the fingers to extend through the panel to provide stops for the components.

In a further embodiment the panel is biased towards the lid by biasing means and movable between an access position, in which the panel is moved towards the lid and a holding position, in which the panel is moved towards the base. The base has at least one finger, which protrudes through at least one corresponding slot in the panel when the panel is in the holding position and which is retracted through the slot when the panel is in the access position. The finger serves as a stop for a component held on the panel when the stop plate is in the holding position.

In another embodiment, the components are held in place by a clip, and depressions are arranged in the panel beneath one end of the components, or the component clips are elevated, so that to remove a component, one end is pushed down into the depression to elevate an opposite end of the component, freeing it from the clip, but preferably still being loosely held by an overlying bridge.

In yet another embodiment, a stop plate is mounted between the panel and the base and biased towards the lid by biasing means and is movable between an access position in which the stop plate is moved towards the base, and a holding position in which the stop plate is moved towards the panel. The stop plate has at least one finger, which protrudes through at least one corresponding slot in the panel when the stop plate is in the holding position and which is retracted through the slots when the stop plate is in the access position. The finger serves as a stop for a component held on the panel when the stop plate is in the holding position.

The preceding are examples of some of the various means which may be employed to implement the objects of the invention. Further features will be described or will become apparent in the course of the detailed description which follows.

BRIEF DESCRIPTION OF THE DRAWINGS

The invention will now be described in greater detail, with reference to the accompanying drawings of the preferred embodiment, in which:

FIG. 7A is a top view of a seventh embodiment, with the lid open;

FIG. 7B is a sectional end view of the seventh embodiment;

FIG. 7C is a sectional side view of the seventh embodiment, showing the lid closed;

FIG. 7D is a sectional end view of the seventh embodiment, showing the lid closed;

DETAILED DESCRIPTION

Figure 1A:
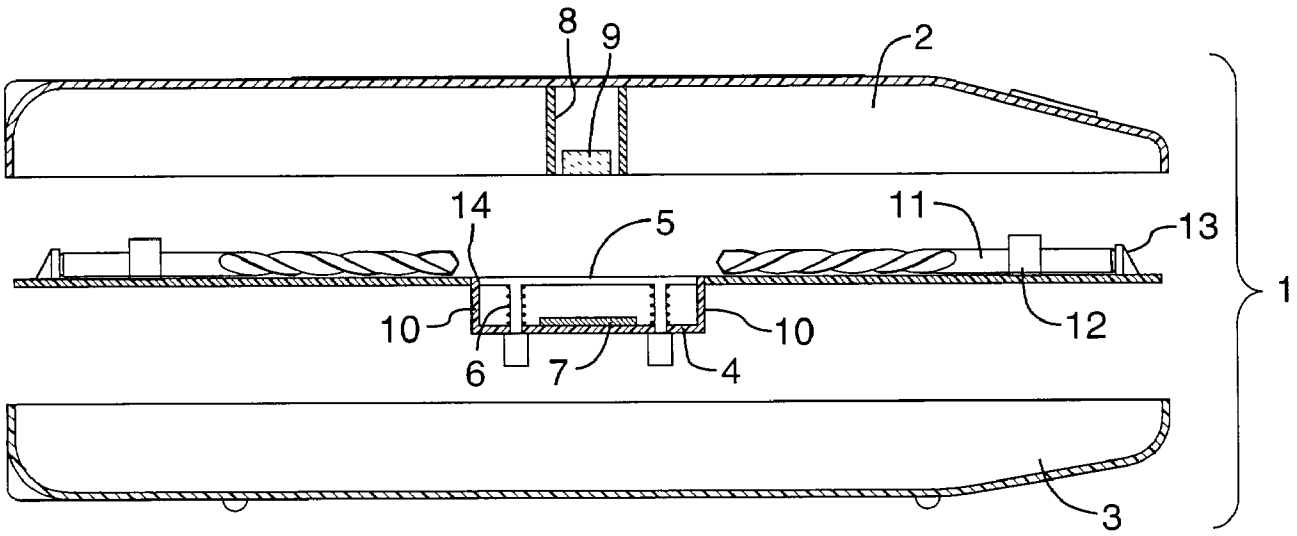
FIG. 1A is an exploded sectional side view of a first embodiment of a tool case according to the invention.
Figure 1B:
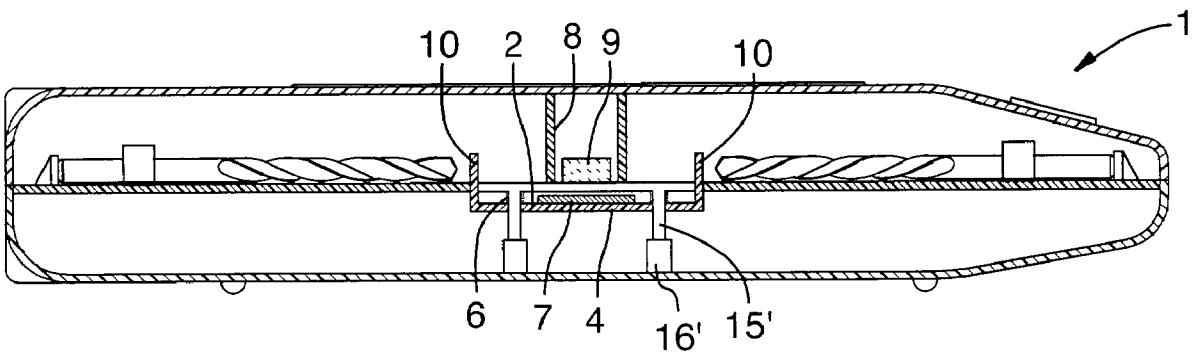
FIG. 1B is an assembled sectional side view of the first embodiment.
Figure 1C:
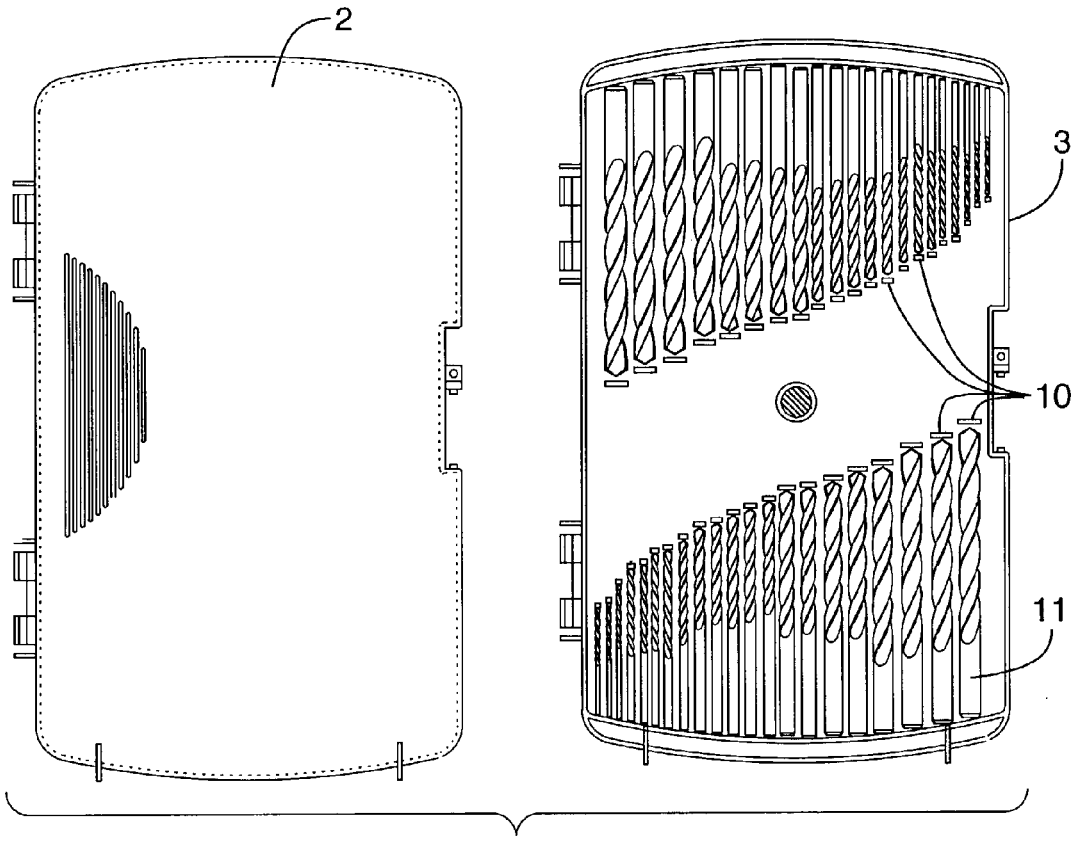
FIG. 1C is a top view of the tool case shown in FIG. 1A, showing the lid removed from the base.
Figure 1D:
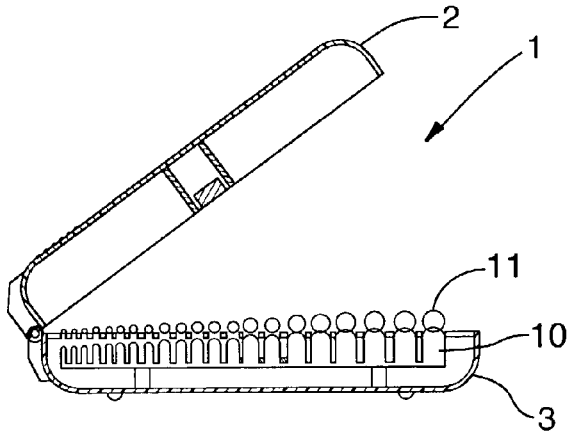
FIG. 1D is a sectional end view of the tool case shown in FIG. 1A, showing the lid open.
Figure 1E:
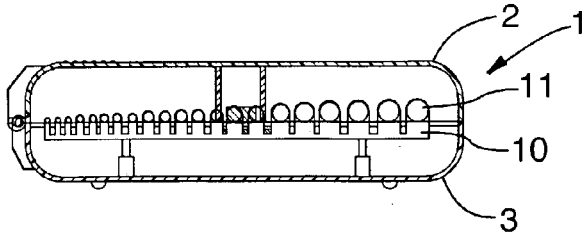
FIG. 1E is a sectional end view of the tool case shown in FIG. 1A, showing the lid closed.

FIGS. 1A to 1E show a first embodiment of a tool case 1 having a top lid 2 and a base portion 3 and an insert panel 5 arranged therebetween. A stop plate 4 is mounted below the panel 5 and kept depressed below the surface of the panel by biasing means 6, for example one or more springs. The panel 5 has protrusions 15', on which the biasing means are slidingly held, the protrusions being fastened to the base 3 by mounting studs 16', or similar. The biasing means are thus mounted between the panel and the stop plate. A magnetic plate 7 is attached to the upper surface of the stop plate. Inside the lid 2 is a molded pocket 8 that contains a magnet 9. When the lid is closed, the magnet attracts the plate and lifts the stop plate so that a plurality of extending fingers 10 on the stop plate project through slots 14 in the panel above the surface of the panel providing stops for the components 11 stored inside the tool case 1. Upon opening, the magnet disengages the plate which is lowered below the surface of the panel, permitting easy removal of components held on the panel. The components are preferably loosely held by bridges 12, which arc over at least a part of the component, and prevented to slide inside the bridge by an end stop 13 and the extending fingers 10, when the lid is closed. When the lid 2 is opened, the fingers retract because the magnet is removed from the magnetic plate and the biasing means 6 push the fingers (and the whole stop plate 4) downwards as shown in FIGS. 1A and 1B. One end of the component 11 is thus freed and can be easily manipulated for removal from the bridge 12. The component stops are shown as fingers, but can also be a stop bar running a substantial length across the panel and acting as stop for more than one component. The stop bar can advantageously be either substantially straight or stepped in configuration, depending upon whether it is desirable to have the component ends aligned along a straight line or along a stepped line. The number of slots in the panel correspond to the actual number of component stops used, i.e. from one common to all components and up to one per component.

Figure 2A:
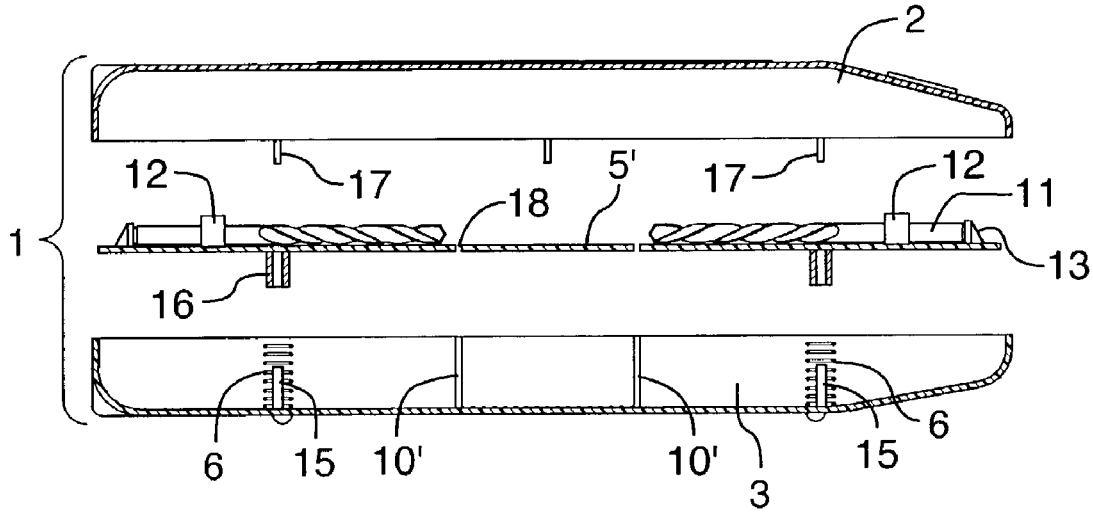
FIG. 2A is an exploded sectional side view of a second embodiment.
Figure 2B:
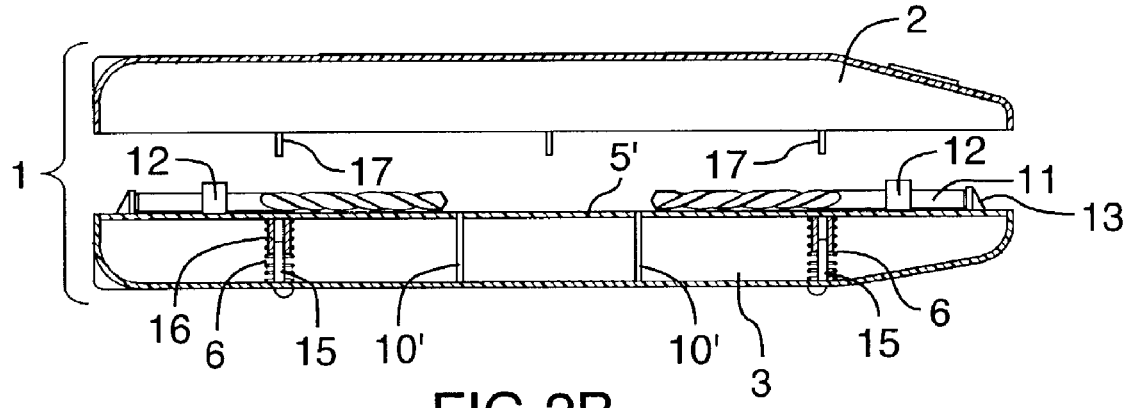
FIG. 2B is an assembled sectional side view of the second embodiment shown in FIG. 2A, showing the lid removed from the base.
Figure 2C:
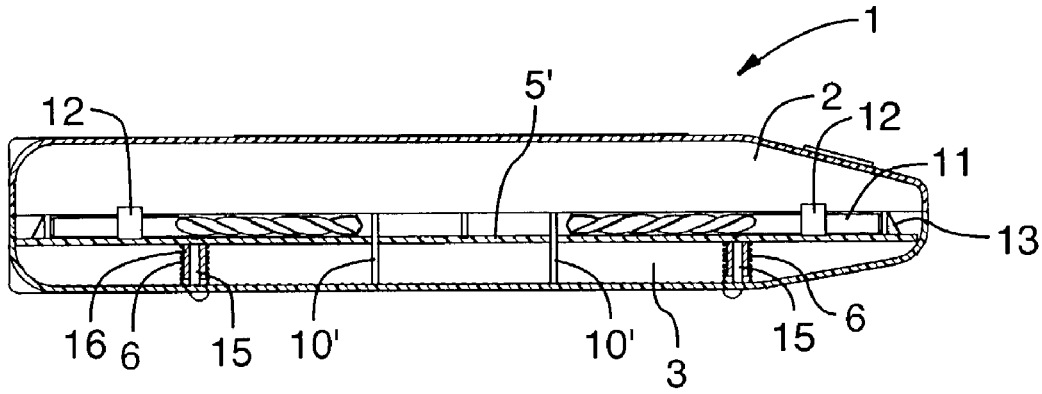
FIG. 2C is an assembled sectional side view of the second embodiment shown in FIG. 2A, showing the lid closed.

FIGS. 2A to 2C show a second embodiment, having a floating panel 5' arranged between the top lid 2 and base portion 3. The panel has hollow protrusions 16 which receive posts 15, preferably molded into the base 3 and the panel is supported by biasing means 6, for example springs. There are stops 10' preferably integrally molded in the base that reach the height of the panel when the lid is open and the panel is fully pressed away from the base by the biasing means. When the lid is closed, ribs 17 preferably molded on the inside of the lid press the panel towards the base and the tip of the stops 10' protrude through slots 18 in the panel to act as further end stops for the components (similar to the fingers described above). Thus, when the lid is open, the panel is urged upwards and clears the stops molded in the base facilitating removal of components, as the lid is closed, the ribs inside the lid depress the panel exposing the stops beyond the ends of the components making it difficult to dislodge the components during handling/storage.

Figure 3A:
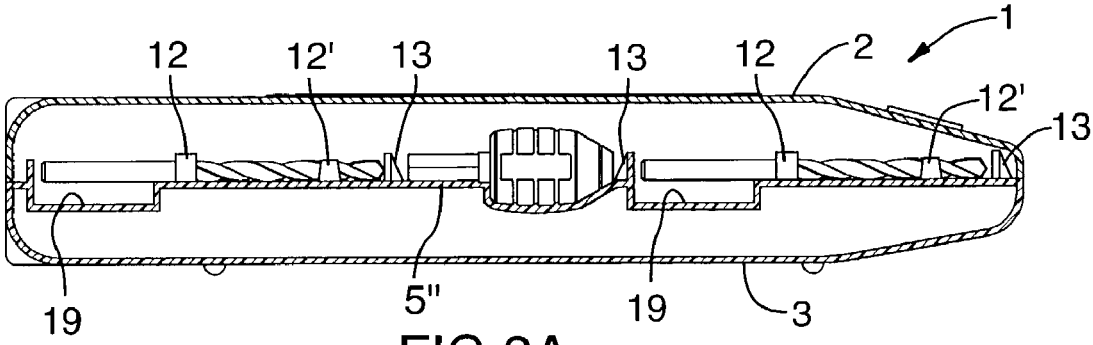
FIG. 3A is a sectional side view of a third embodiment.
Figure 3B:
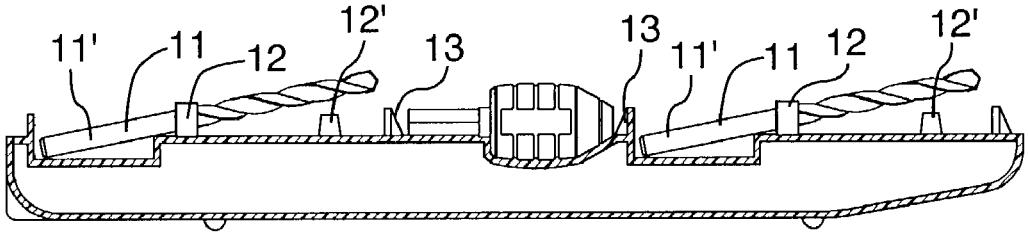
FIG. 3B is a sectional side view of the third embodiment shown in FIG. 3A, showing the lid removed from the base.

FIGS. 3A to 3B show a third embodiment, having a panel 5" between the top lid 2 and base portion 3. Fixed end stops 13 are used to prevent the components 11 from sliding too much in the panel. The end stops are preferably molded in the panel. The component is placed on the panel and held in place by a combination of a clip 12' and a bridge 12. The bridge is used to align the component during insertion into the tool case/clip. Beneath one end 11' of the components are depressions 19 in the panel 5". To remove a component, the one end 11' is pushed down into the depression. This elevates the opposite end of the component, freeing it from the clip 12' but still restrained by the bridge 12. The component can then be easily pulled out for use.

Figure 4A:
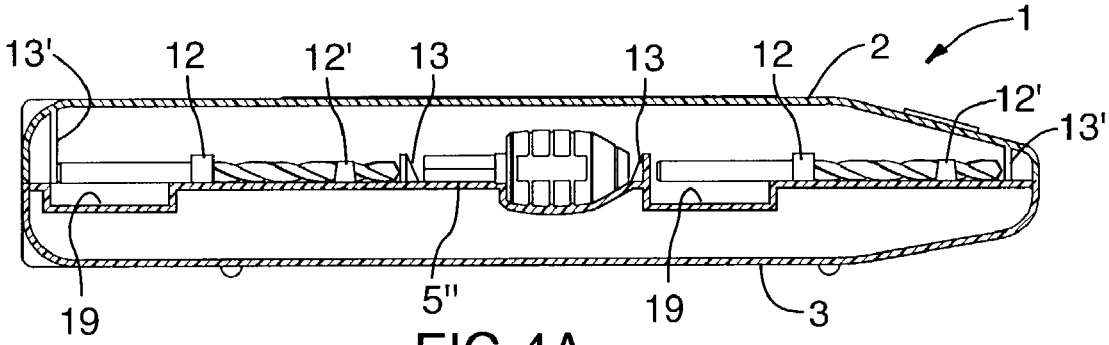
FIG. 4A is a sectional side view of a fourth embodiment.
Figure 4B:
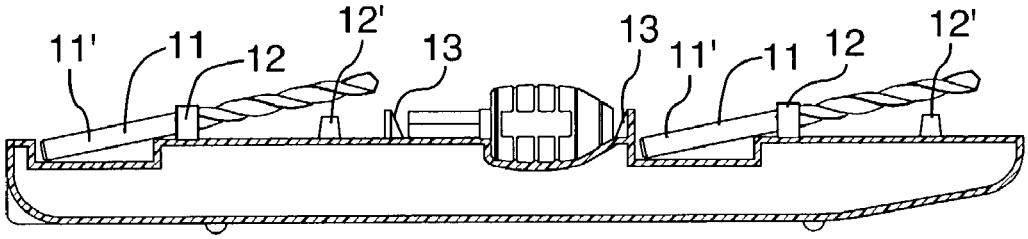
FIG. 4B is a sectional side view of the fourth embodiment shown in FIG. 4A, showing the lid removed from the base.
Figure 5A:
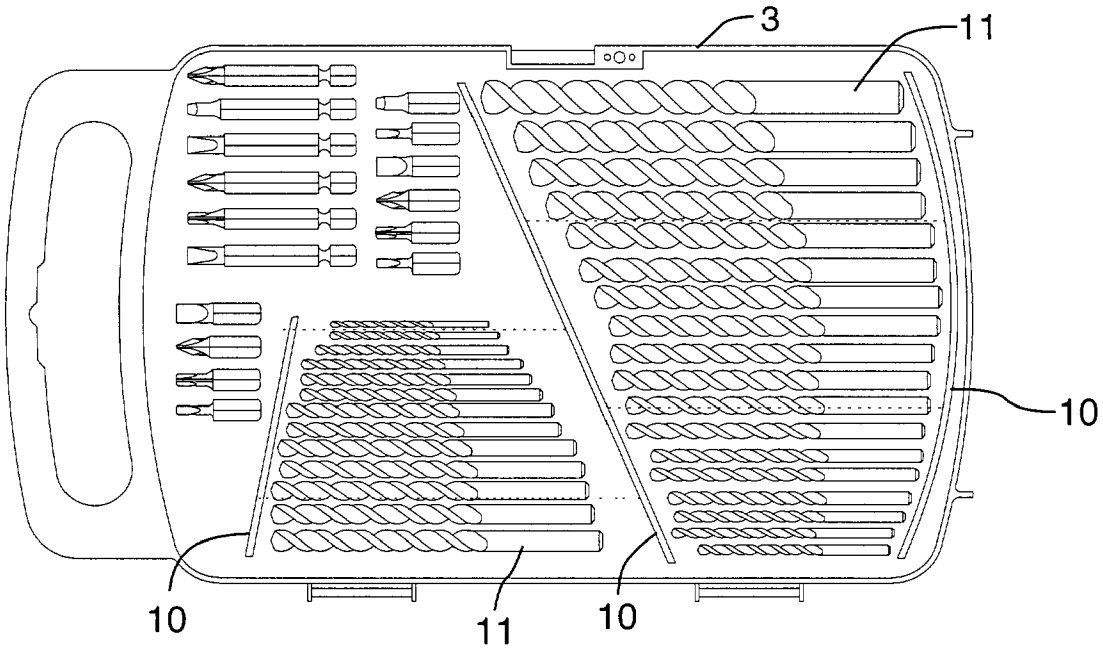
FIG. 5A is a top view of a fifth embodiment, with the lid removed from the base.
Figure 5B:
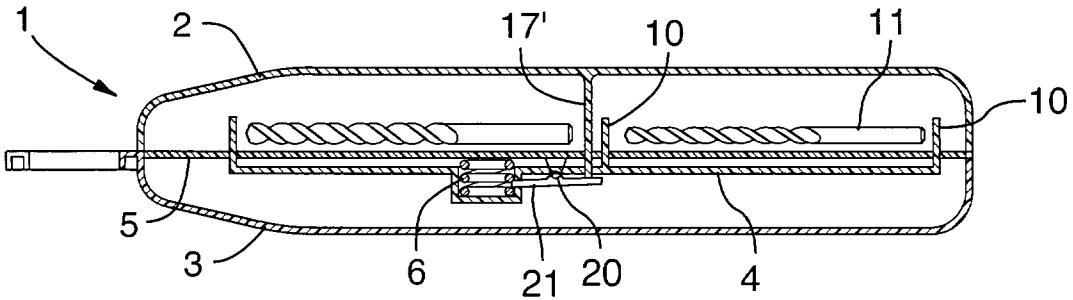
FIG. 5B is a sectional side view of the fifth embodiment shown in FIG. 5A.
Figure 5C:
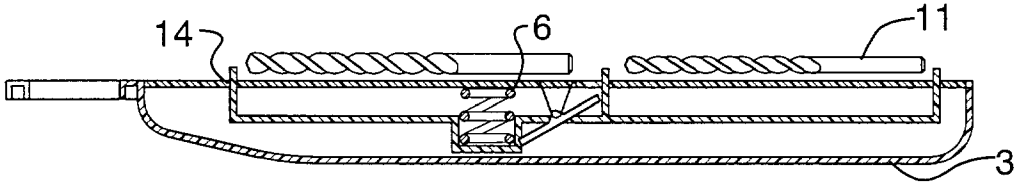
FIG. 5C is a sectional side view of the fifth embodiment shown in FIG. 5B, showing the lid removed from the base.
Figure 6A:
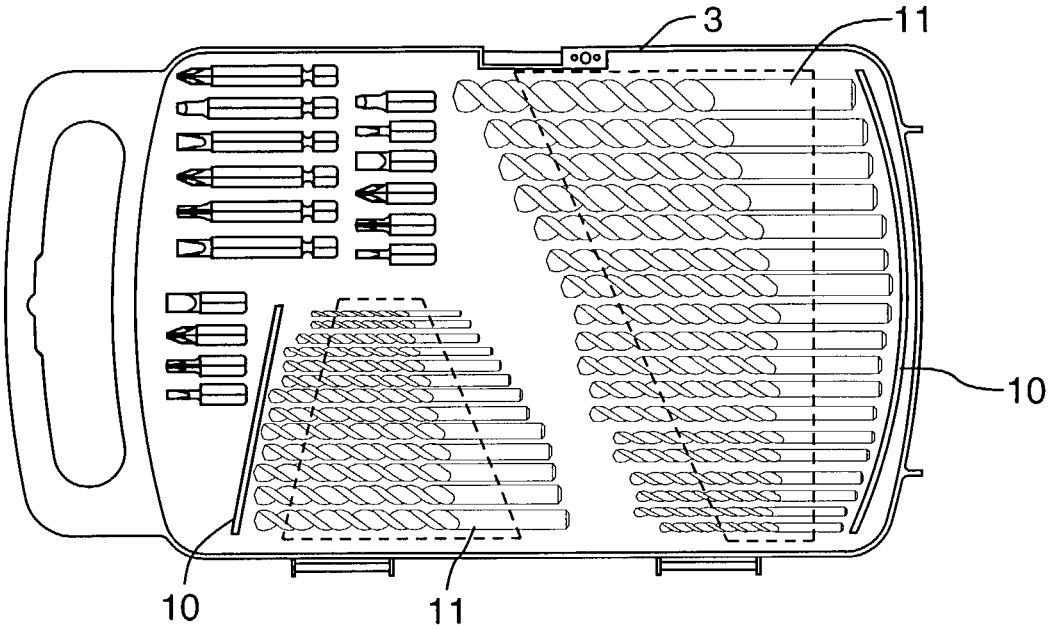
FIG. 6A is a top view of a sixth embodiment, with the lid removed from the base.
Figure 6B:
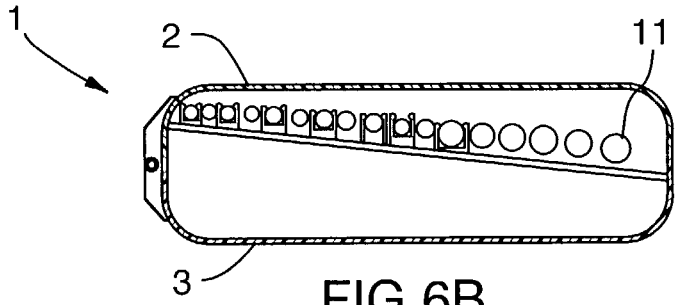
FIG. 6B is a sectional end view of the sixth embodiment shown in FIG. 6A, showing a sloping panel arrangement.
Figure 6C:
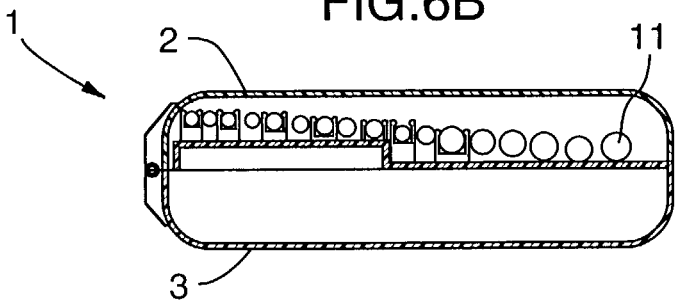
FIG. 6C is a sectional end view of the sixth embodiment shown in FIG. 6A, showing a stepped panel arrangement.
Figure 6D:
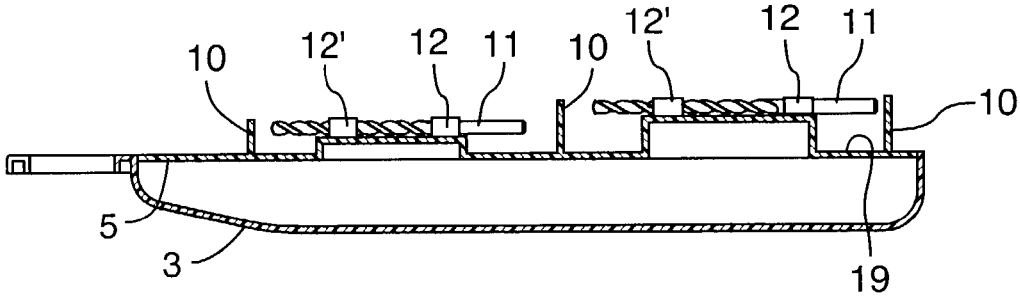
FIG. 6D is a sectional side view of the sixth embodiment shown in FIG. 6A, showing the lid removed from the base.
Figure 7E:
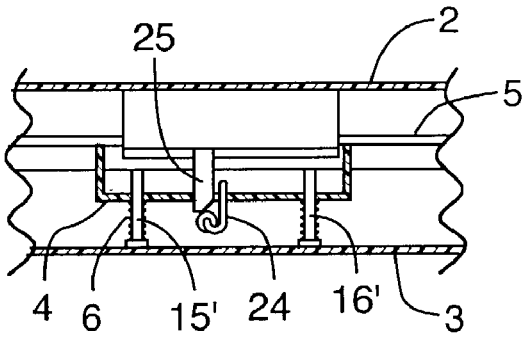
FIG. 7E is a sectional detail side view of the seventh embodiment showing the lid closed.
Figure 7G:
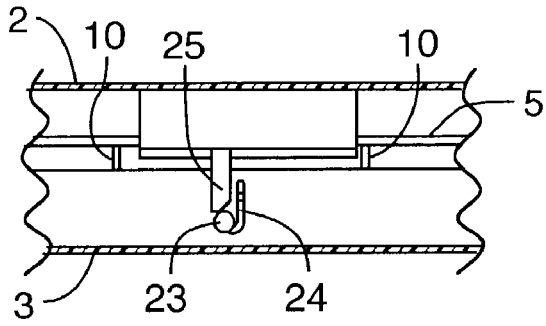
FIG. 7G is a detail side view of the seventh embodiment, showing the lid closed.
Figure 7F:
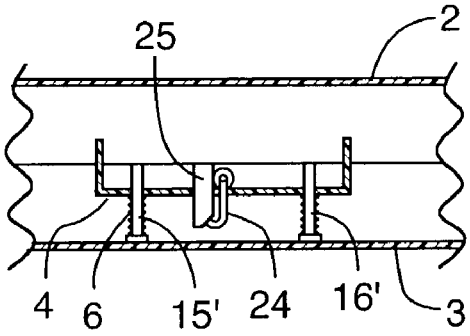
FIG. 7F is a sectional detail side view of the seventh embodiment, showing the lid open.
Figure 7H:
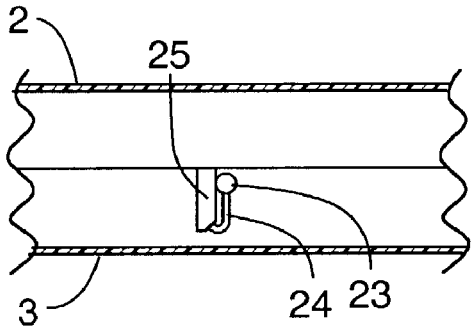
FIG. 7H is a detail side view of the seventh embodiment, showing the lid open.
Figure 8B:
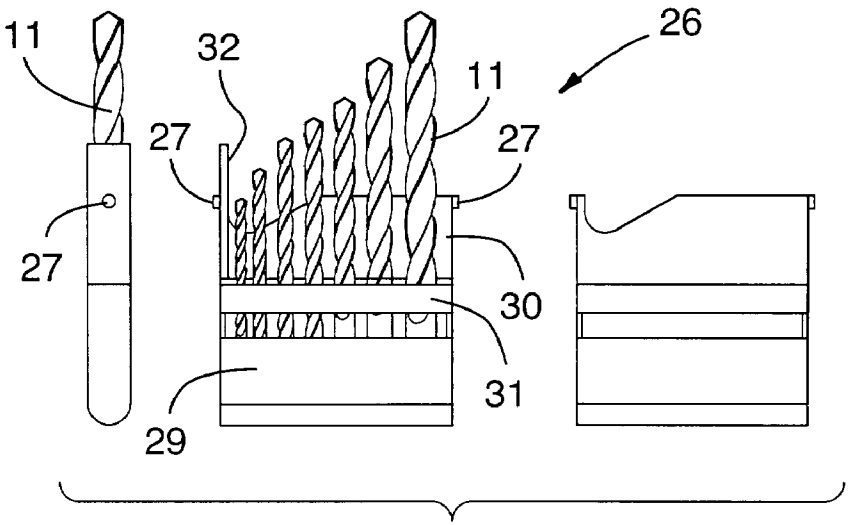
FIG. 8B is a detail view of the eighth embodiment shown in FIG. 8A, showing the holder.
Figure 8A:
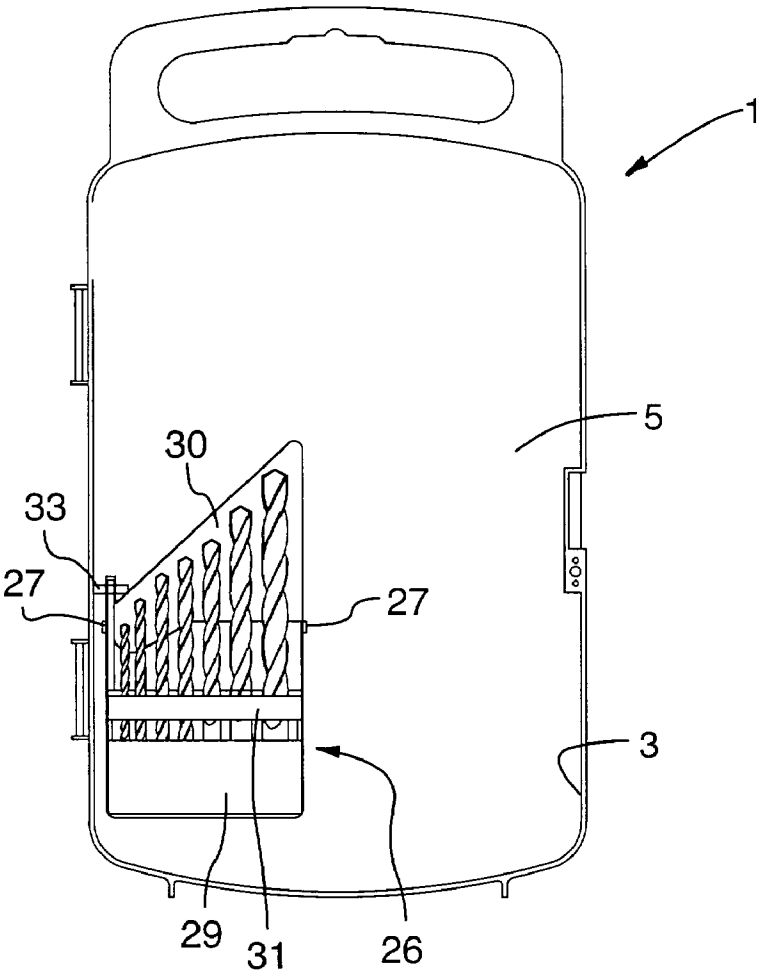
FIG. 8A is a top view of an eighth embodiment.
Figure 8E:
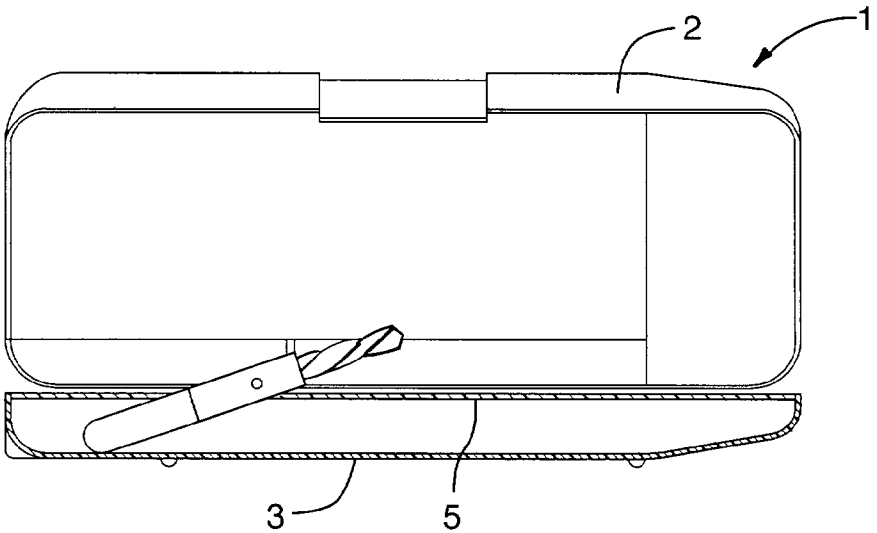
FIG. 8E is a sectional side view of the eighth embodiment, showing the lid open.
Figure 8F:
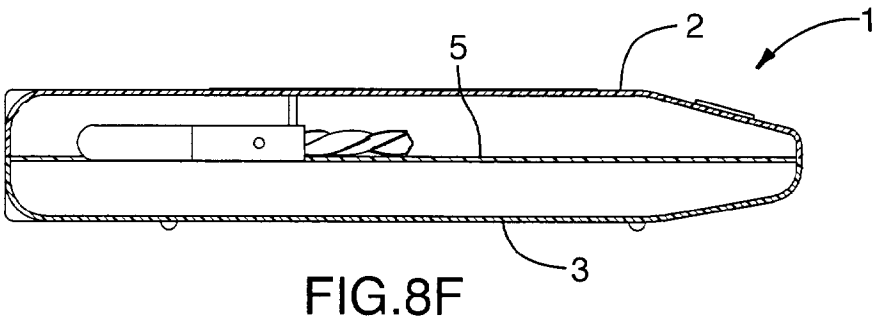
FIG. 8F is a sectional side view of the eighth embodiment, showing the lid closed.
Figure 8C:
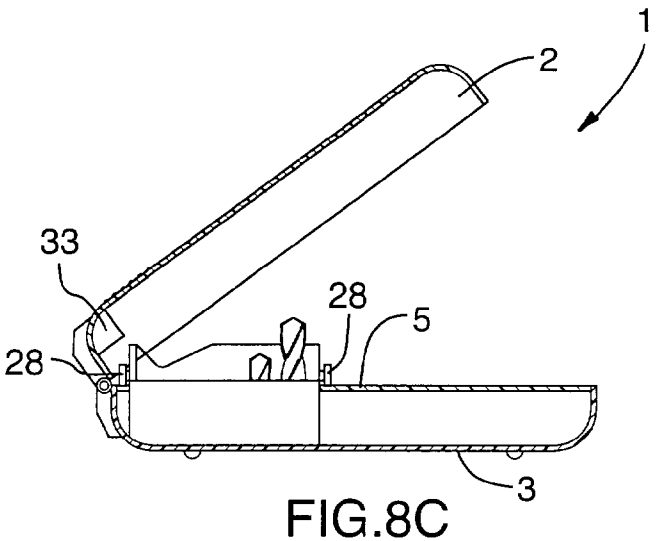
FIG. 8C is a sectional end view of the eighth embodiment, showing the lid open.
Figure 8D:
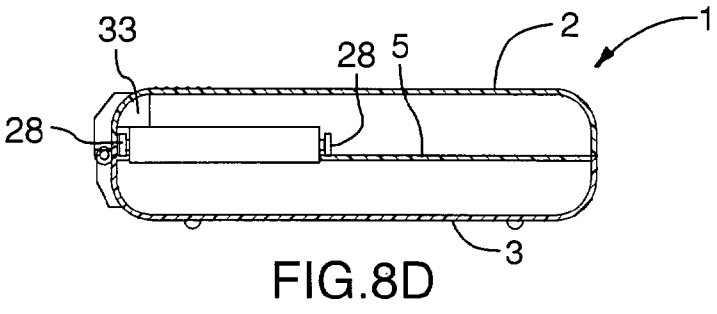
FIG. 8D is a sectional end view of the eighth embodiment, showing the lid closed.

FIGS. 4A to 4B show a fourth embodiment of a tool case 1 similar to the third embodiment. Some end stops 13' are not part of the panel, but rather a double-walled construction is used on the lid. This provides immobility for the part when the case is closed as described above. FIGS. 5A to 5C show a fifth embodiment. This embodiment is similar to the first embodiment. The stop plate 4 is mounted below the panel and biased away from the panel by means of biasing means 6, for example one or more springs, when the case is open. The fingers 10 are then slid through the slots 14, permitting easy removal of the components 11 when the lid is open. Attached to the panel 5 via a mounting post 20 is a lever 21 that pivots on the underside of the panel. When the lid is open, the lever is free to pivot with the stop plate 4 movement. When the lid is closed, a rib or post 17', preferably molded on the inside of the lid, presses the stop plate towards the lid and the tip of the fingers 10 protrude through slots 14 in the panel to act as further end stops for the components (similar to the fingers described above).

FIGS. 6A to 6D show a sixth embodiment, similar to the third and fourth embodiments. The case has a panel that incorporates recesses, stops, and different elevations all molded as part of the panel. The removal process is similar to that described for embodiments three and four above.

FIGS. 7A to 7H show a seventh embodiment. This embodiment is somewhat similar to the first embodiment, but the stop plate 4 mounted below the panel 5 is biased upwards by means of biasing means 6, for example one or more springs. The biasing means are thus mounted between the base 3 and the stop plate 4. A long lever 22 having an end knob 23 for facilitated manipulation, is pivotably connected to one side of the base and extends across the stop plate and protrudes through the opposite side of the base via a J-shaped opening 24. The long lever provides a manual means to raise and lower the fingers 10. When the lid is open, the end of the long lever is pushed along the J slot and inserted in the short end (base end or "dead end") of the J to retain it. This lowers the stop plate and makes the components easily accessible. When the lid is closed, a tapered projection 25 on the edge of the lid urges the lever out of the short end of the J and the stop plate is biased upwards, providing the stops for the components.

FIGS. 8A to 8F show an eighth embodiment. The panel has recesses (omitted for clarity) accommodating at least one pivotable holder 26. Components 11 are placed in the pivotable holder, which is then attached to the panel by means of pivot pins 27 (preferably molded on the sides of the pivotable holder) and mounting holes (not shown) through side walls 28 of the recesses. The pivot points are located such that the holder 26 pivots up to expose the components in their free position, when the lid 2 is open. The holder preferably have an enclosed end 29, an open end 30 and a hold down bar 31. The components are inserted into the holder via the open end and securely held by the enclosed end in cooperation with the hold down bar. The holder further has an extension arm 32, preferably integrally molded with the holder, on one side of said holder protruding from the open end 30. The lid has an activation ridge 33, preferably integrally molded with the lid, on an inside edge of the lid. Upon closing, the activation ridge depresses the extension arm 32 and urges it flat into the recess preventing removal or dislodging of components held in the holder 26. The holder thus forms an unbalanced see-saw, when it is mounted in a recess of the panel 5, with the heavy end being the enclosed end 29.

Figure 9A:
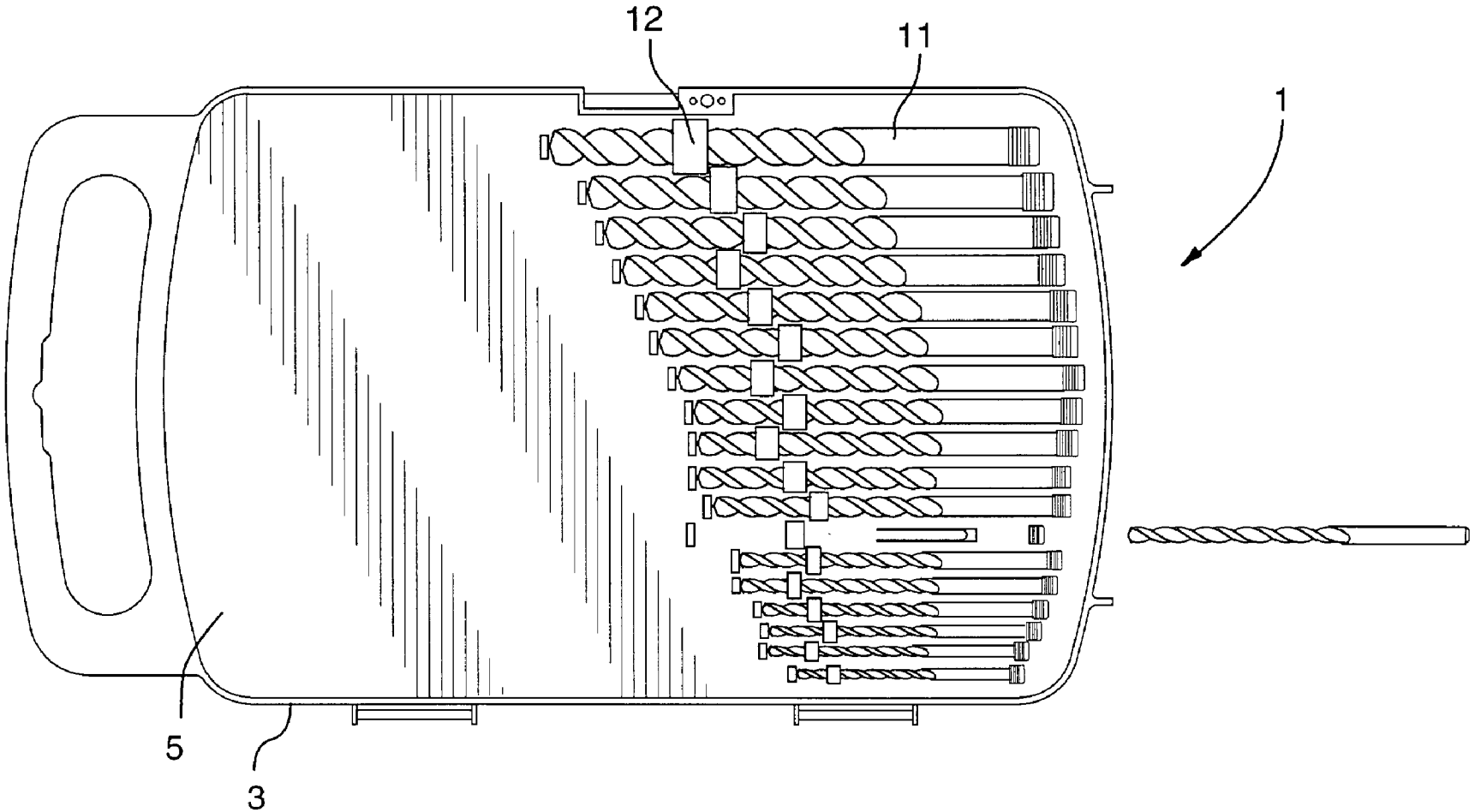
FIG. 9A is a top view of a ninth embodiment, showing the lid removed from the base.
Figure 9B:
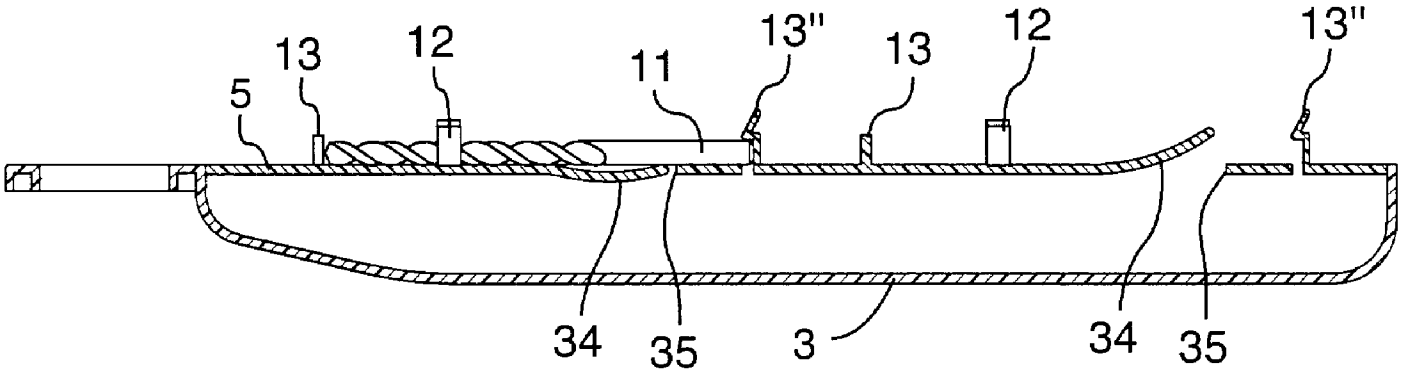
FIG. 9B is a sectional side view of the ninth embodiment.
Figure 9C:
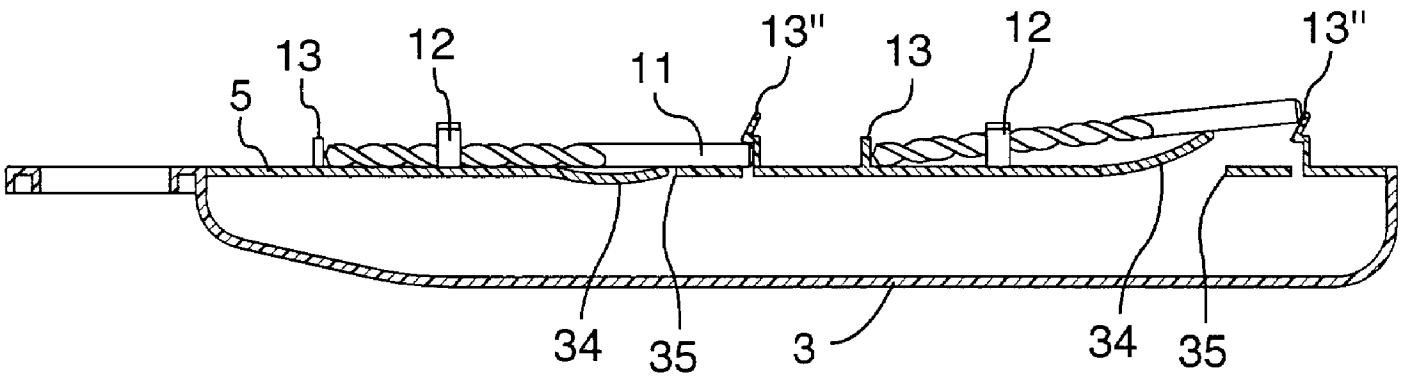
FIG. 9C is a further sectional side view of the ninth embodiment.

FIGS. 9A to 9C show a ninth embodiment. The panel 5 has spring tongues 34 and bridges 12, which preferably are integrally molded with the panel. Components 11 are placed through the bridges 12 and the ends of the components snapped into place for retention. To remove the components, retainers 13" are bent away from the components and the spring tongues urge the components up and away from the retainers and the panel for removal. The spring tongues are surrounded by a tongue slit 35 on all but one side.

Figure 10A:
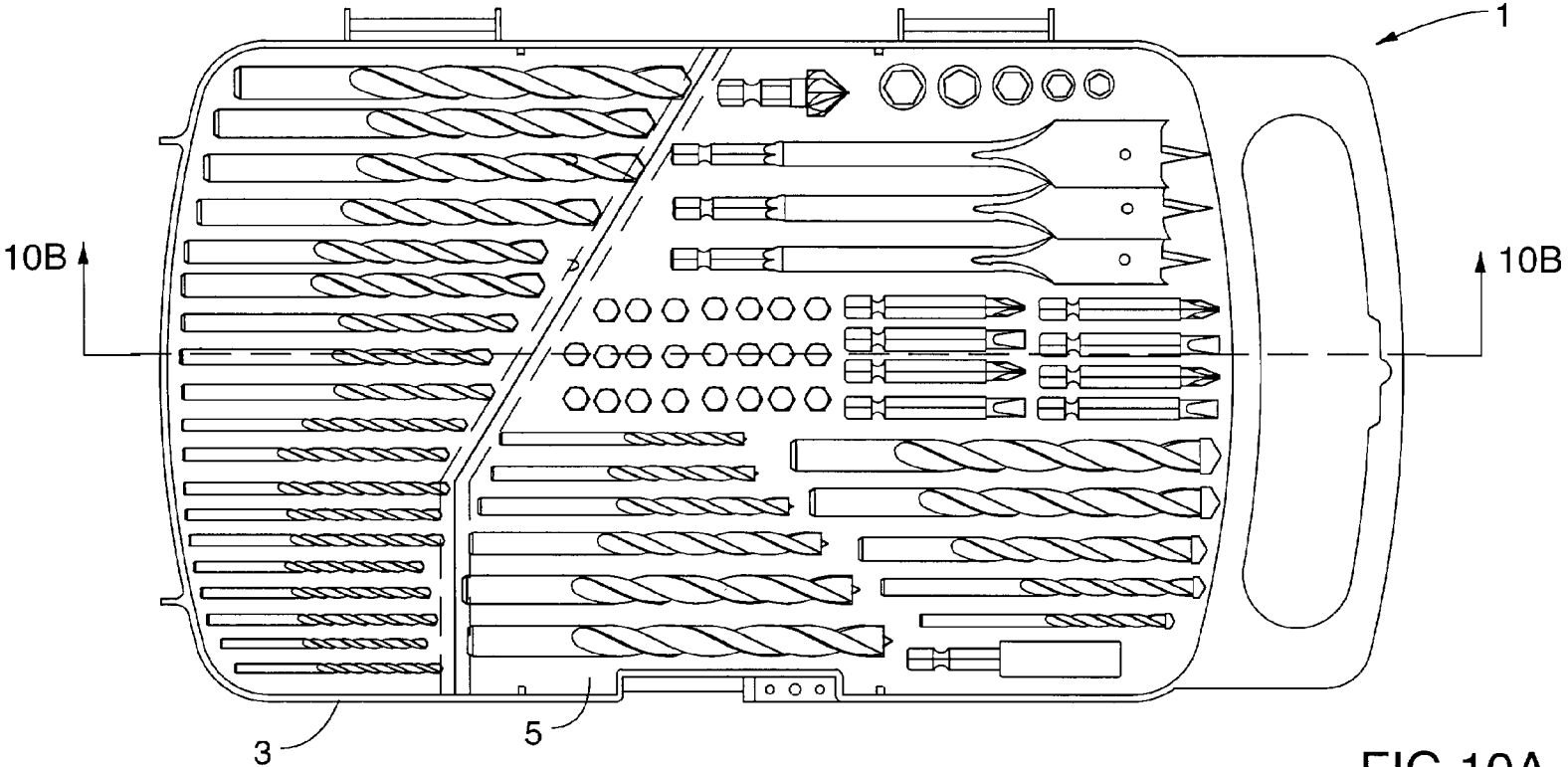
FIG. 10A is a top view of a tenth embodiment.
Figure 10B:
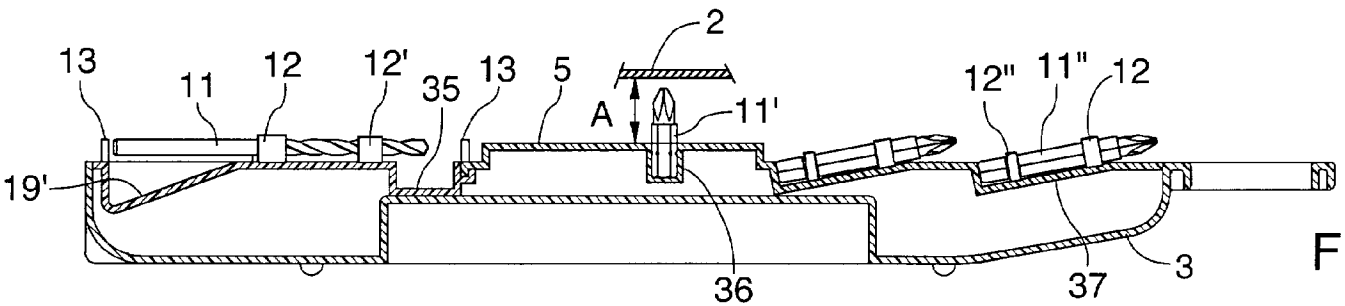
FIG. 10B is a sectional side view of the tenth embodiment.

FIGS. 10A to 10B show a tenth embodiment. The panel has a recess 19' corresponding to the earlier described depression 19, so that one end of the component 11 can be pressed down to free the other end from the clip and elevating it for easy removal. The recess 19' has a sloping floor, as opposed to the depression 19, which has a level floor. Finger access depressions 35 have also been provided for ease of removal, either before or after the component is pressed down with one end into the recess 19'.

Usually, small power bits 11'(around 25 mm in length) are difficult to remove from their panel holes 36. The section(s) of the panel in which the small power bits are stored can be raised and the fit of the bit in the panel hole can be made loose. In this way, the lid 2 prevents the components from falling out of the panel holes when the lid is closed, yet the bits are easily removed when the lid is opened. The distance between the top surface of the panel and the inner surface of the lid is designated A, and should be of a length that leaves less space between the tip of the small power bit and the lid than the distance the bit is inserted into the panel holes, to prevent the bits from sliding out of the panel holes when the lid is closed.

Figure 14D:
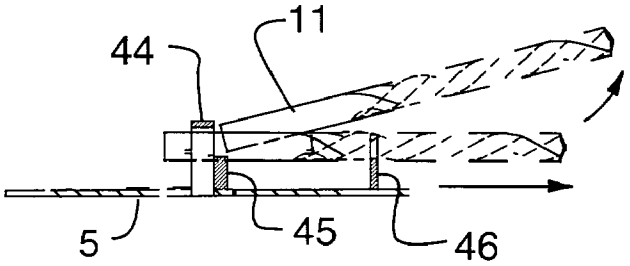
FIG. 14D is a side view corresponding to FIG. 14C, showing removal of the drill bit.
Figure 14C:
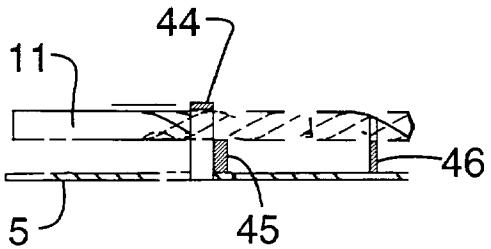
FIG. 14C is a side view of a drill bit retention feature of the fourteenth embodiment.
Figure 14B:
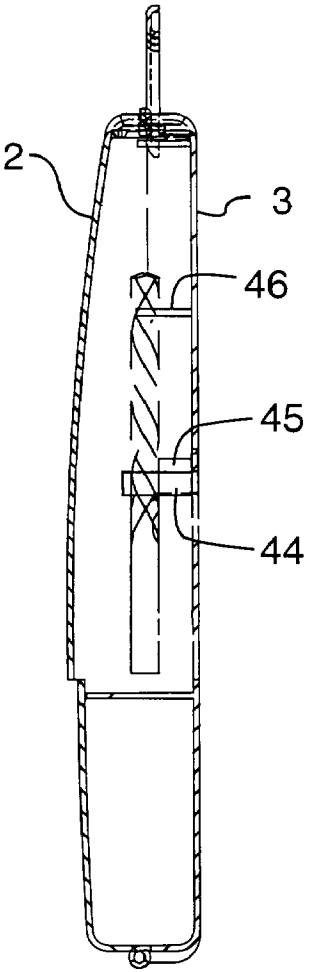
FIG. 14B is a side view of the fourteenth embodiment.
Figure 14A:
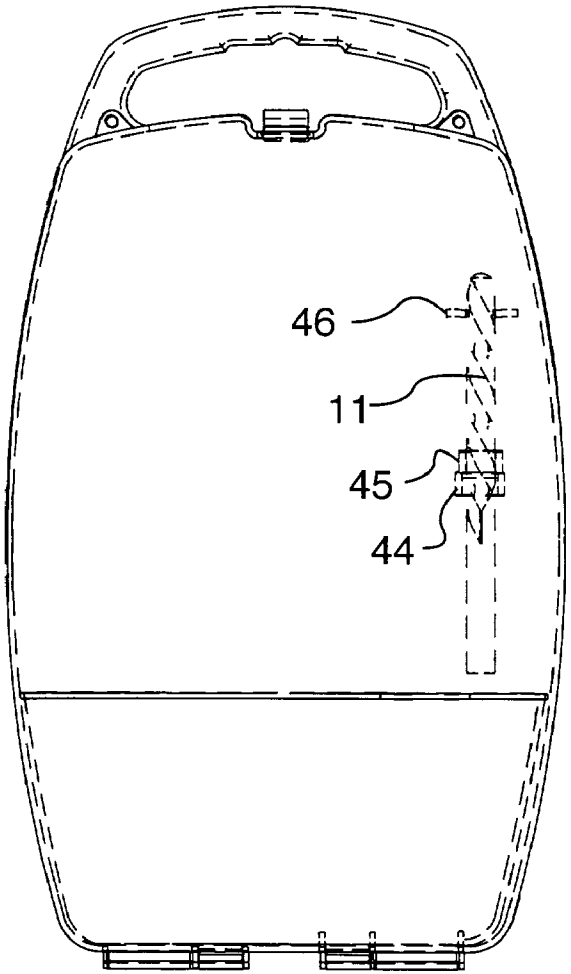
FIG. 14A is a top view of a fourteenth embodiment.

Longer power bits 11"(e.g. 50 mm in length) are preferably held by clips 12 on angled surfaces 37 or on elevated surfaces such as a fulcrum bar 45 and clip 46 (see FIGS. 14C and 14D). An end clip 12" is preferably used in the notch of the bit to prevent longitudinal movement, while the clip 12 holds the body of the long power bit. Because of the angular or flat elevated position, finger access is facilitated and removal made easier, because a finger can easily access the under side of the end of the bit.

FIGS. 11A-11D show an eleventh embodiment, in which bits 11 are mounted at an angle relative to the base 3, for easy access, and in which the lid 2 when closed prevents the bits from falling out of the apertures in which they sit. Note that the lid does not have to contact the bits; it merely has to be sufficiently close to the bits to prevent them from having enough clearance to fall out of their apertures.

Figure 11B:
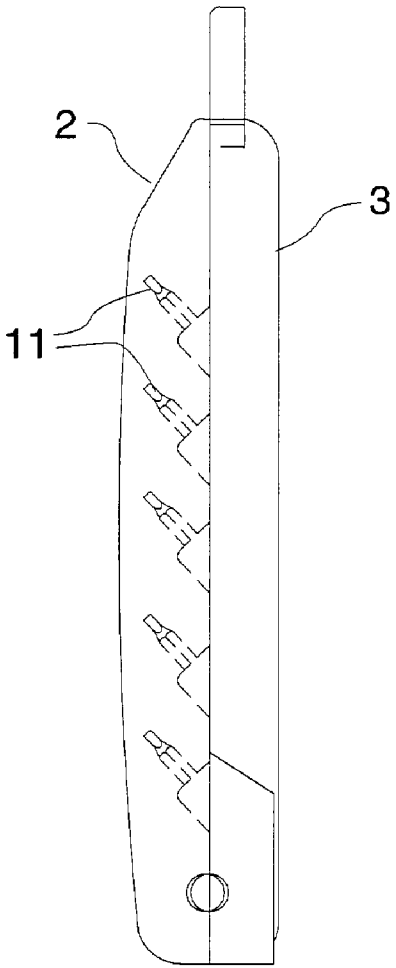
FIG. 11B is a sectional side view of the eleventh embodiment.
Figure 11A:
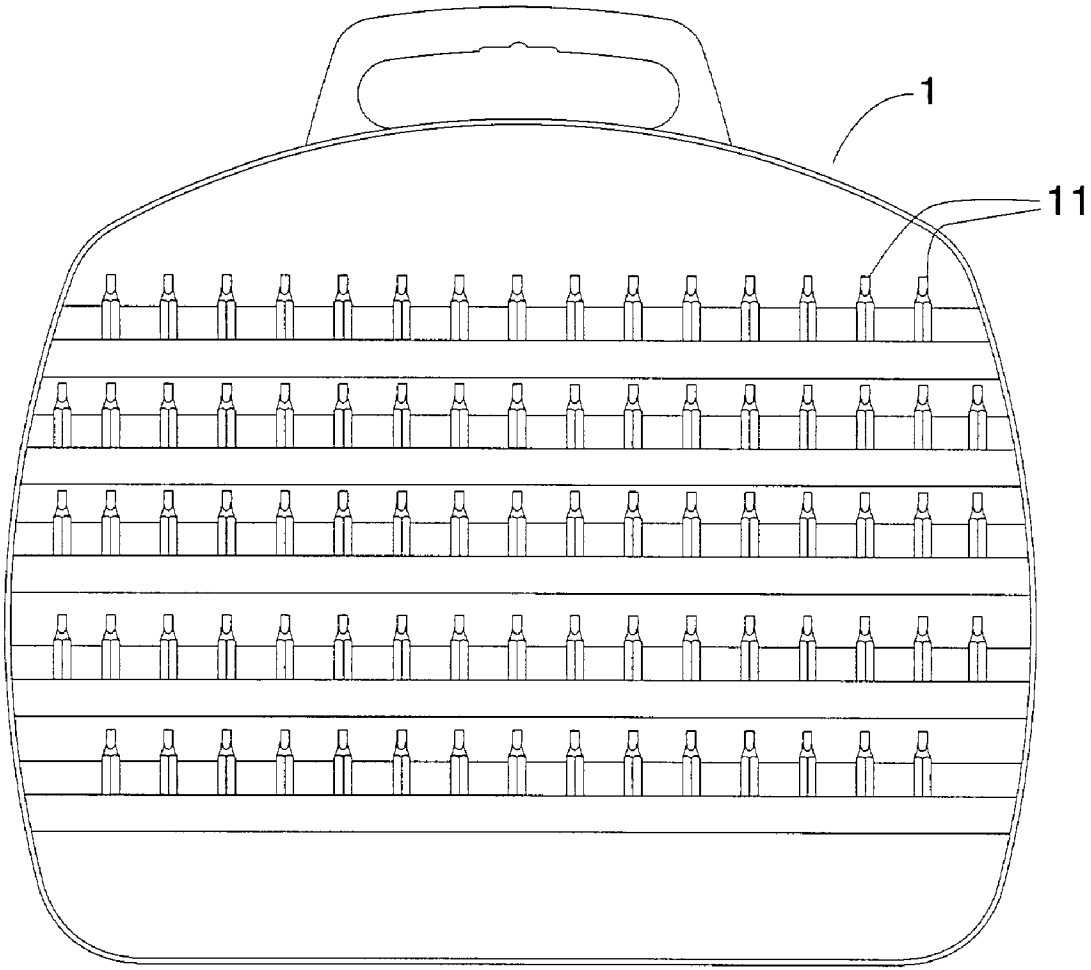
FIG. 11A is a top view of an eleventh embodiment.
Figure 11D:
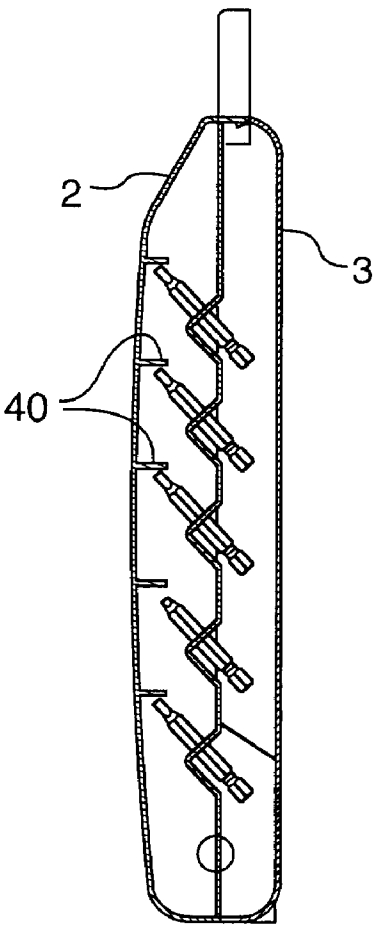
FIG. 11D is a sectional side view of the variation.
Figure 11C:
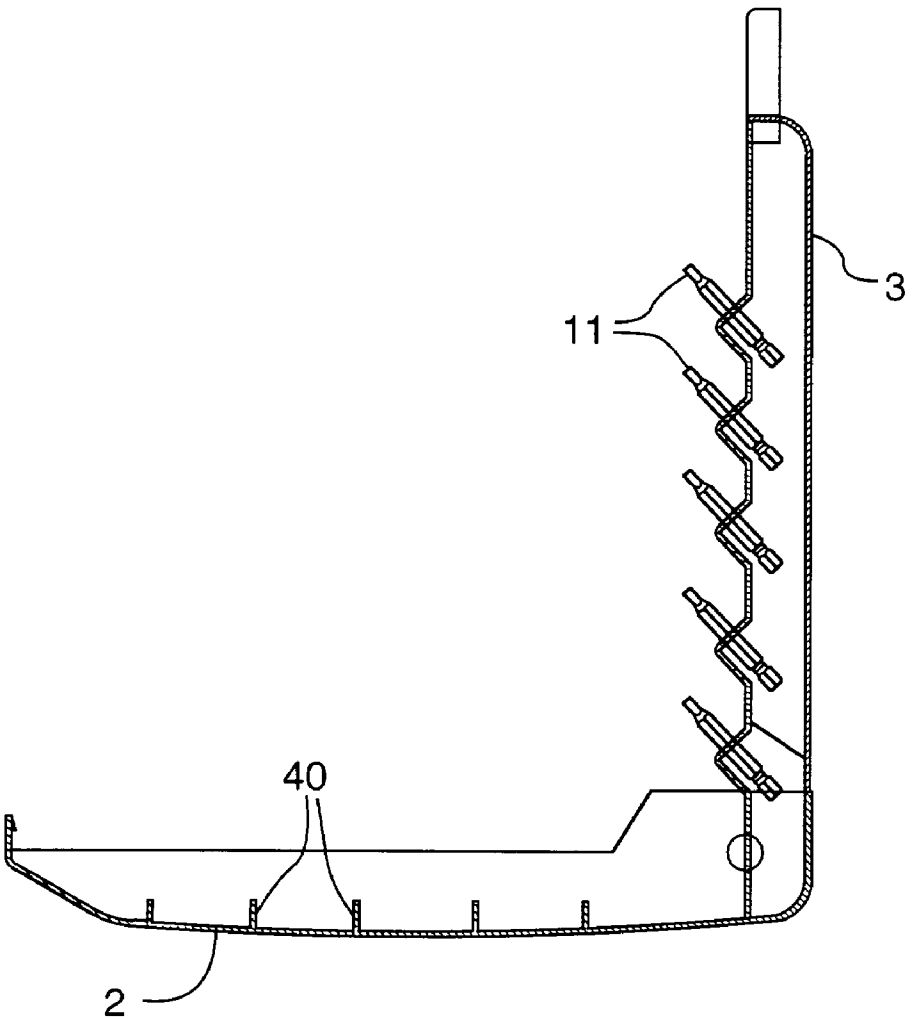
FIG. 11C is a sectional side view of a variation of the eleventh embodiment.
Figure 12A:
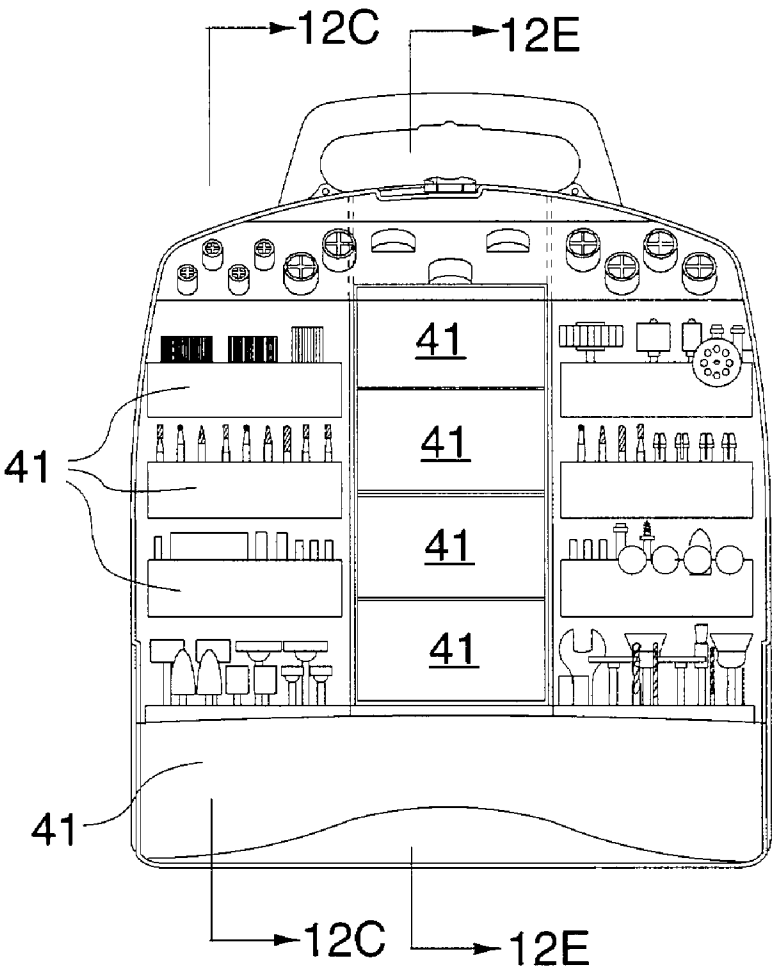
FIG. 12A is a top view of a twelfth embodiment.
Figure 12B:
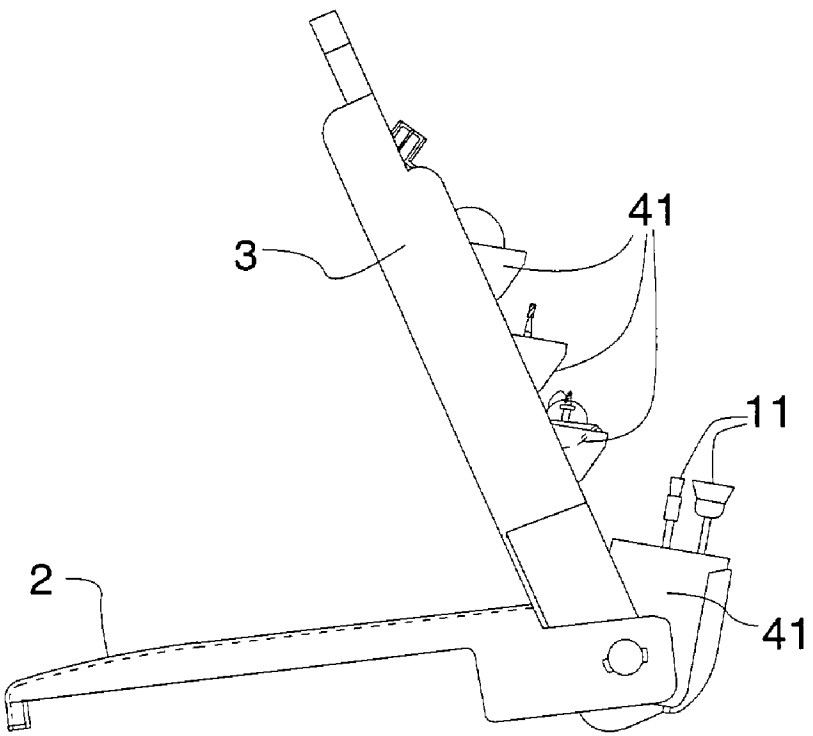
FIG. 12B is a side view of the twelfth embodiment, with the case open.
Figure 12E:
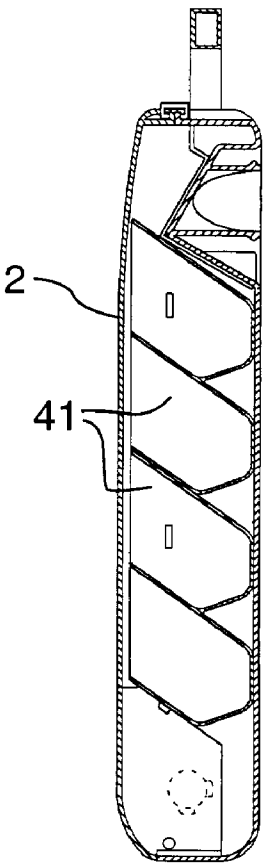
FIG. 12E is a sectional side view corresponding to FIG. 12D, with the lid closed.
Figure 12D:
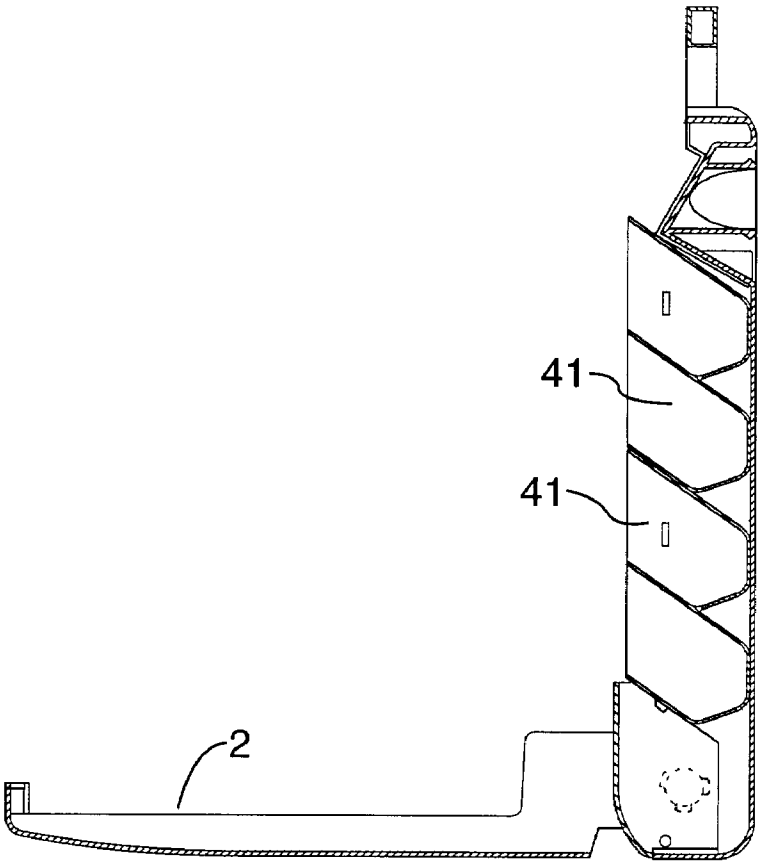
FIG. 12D is a sectional side view of the twelfth embodiment, at 12E on FIG. 12A, with the lid open.
Figure 12C:
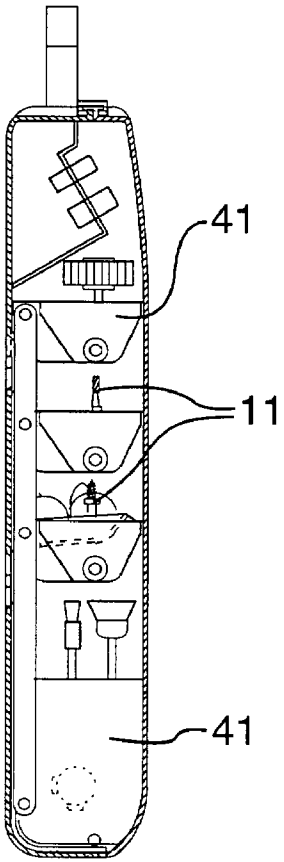
FIG. 12C is a side view of the twelfth embodiment, with the case closed.
Figure 13B:
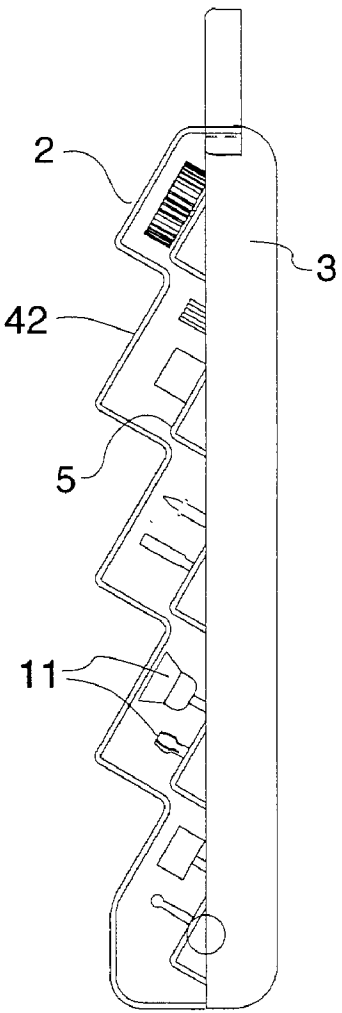
FIG. 13B is a side view of the thirteenth embodiment.
Figure 13A:
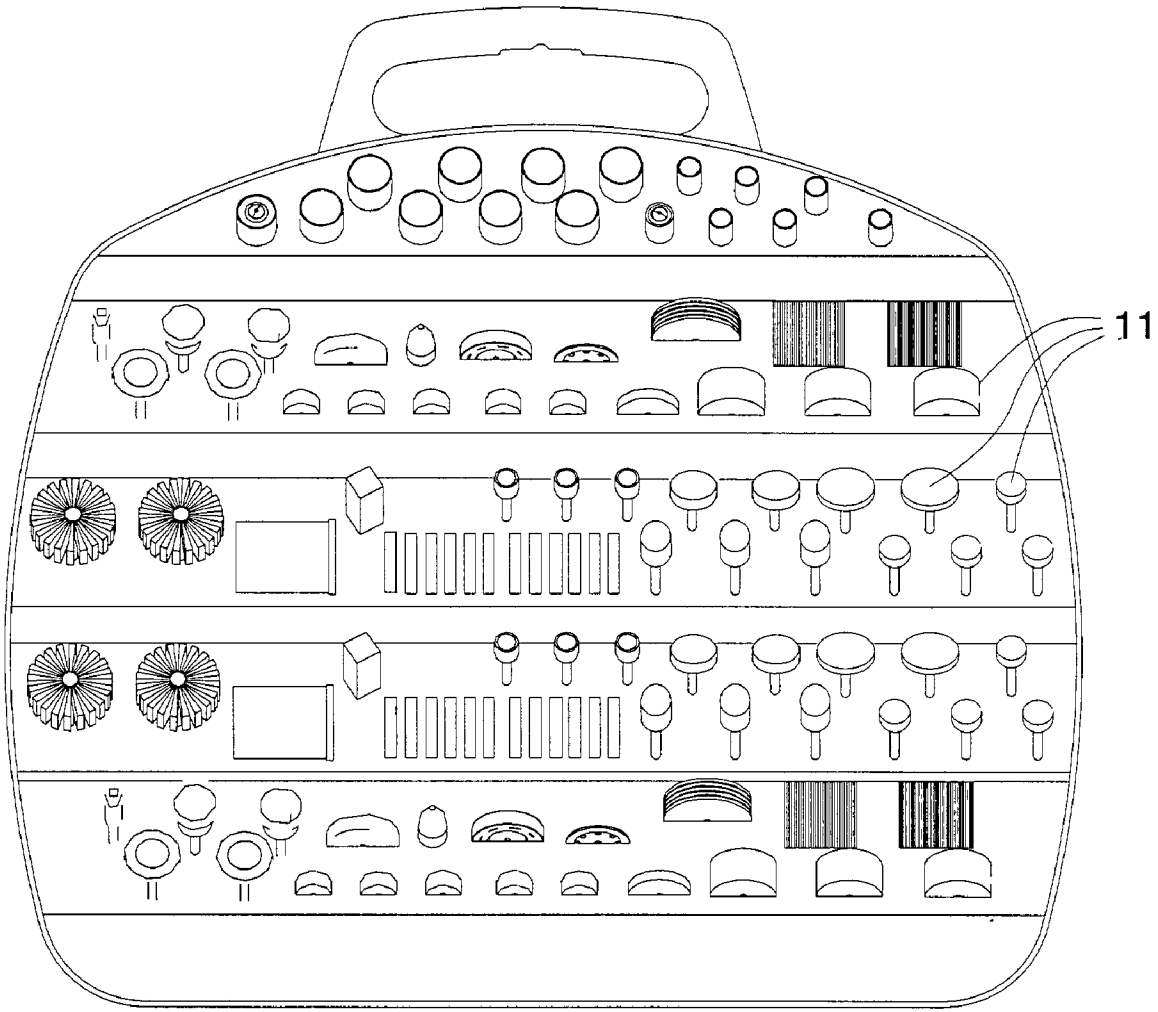
FIG. 13A is a top view of a thirteenth embodiment.
Figure 13D:
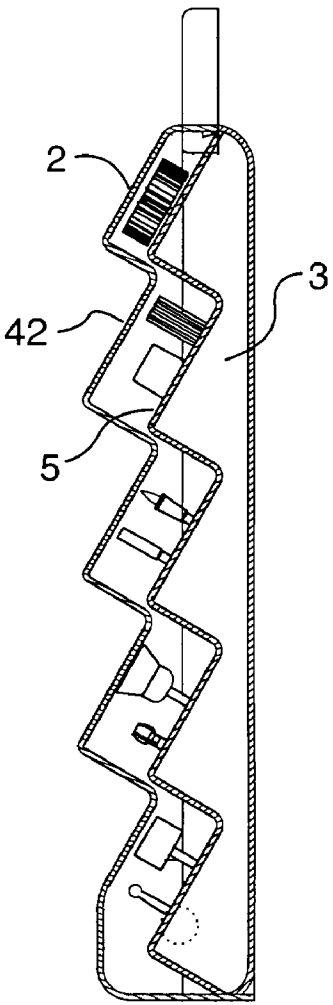
FIG. 13D is a view corresponding to FIG. 13C, with the lid closed.
Figure 13C:
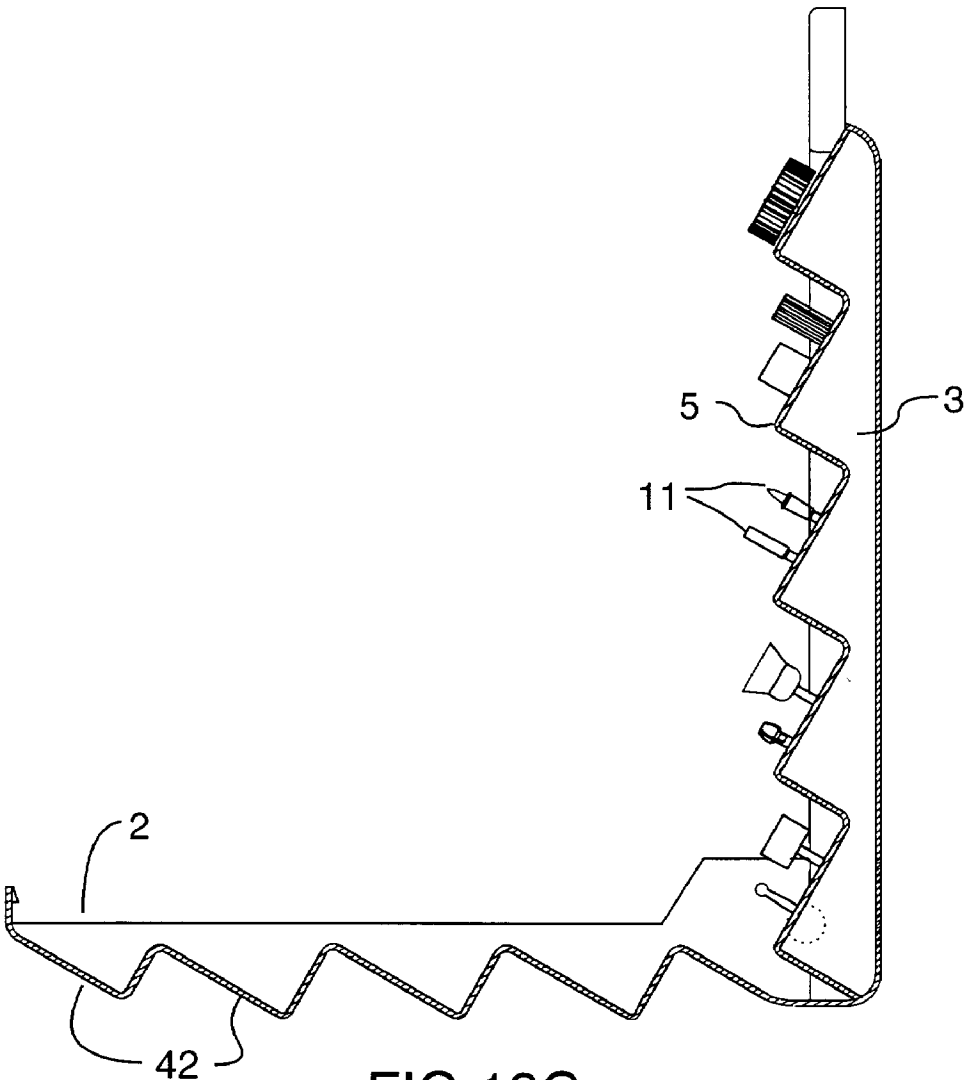
FIG. 13C is a sectional side view of the thirteenth embodiment, with the lid open.

FIGS. 11C and 11D show a variation in which the lid 2 is provided with ribs 40 which prevent withdrawal of the bits, instead of relying on the lid itself. The ribs of course have the added benefit of strengthening the lid.

FIGS. 12A-12E show a twelfth embodiment, in which there are a variety of pivotable holders 41, which pivot to an easy access position when the lid 2 is open, but which are closed when the lid is closed, and are configured relative to each other such that in the closed position, any components 11 are trapped, either by being unable to be extracted because of proximity to another holder or to a part of the case, or by being within a compartment which is closed off by proximity to another holder or to a part of the case.

FIGS. 13A-13D show a thirteenth embodiment, which is similar to the 11$^{th}$ embodiment. The bits or other components 11 are mounted at an angle relative to the base 3, for easy access, and the lid 2 when closed prevents the bits from falling out of the apertures in which they sit. In this embodiment, the lid preferably has angled surfaces roughly paralleling the surfaces of the panel 5, so that the lid surfaces are roughly at right angles to the axes of the components. Again, note that the lid does not necessarily have to contact the components; it merely has to be sufficiently close to the bits to prevent them from having enough clearance to fall out of their apertures.

FIGS. 14A-14D show a fourteenth embodiment, which is similar to the third, fourth, sixth and tenth embodiments. FIG. 14C shows a bridge 44 over a drill bit 11, with a fulcrum bar 45 adjacent the bridge and under the drill bit. The distal end of the drill bit is held by a clip 46. Pressing on the shank end of the drill bit causes rotation of the drill bit about the fulcrum bar 45, such that the distal end snaps out of the clip 46, allowing the drill bit to be extracted from under the bridge 44, as shown in FIG. 14D.

Figure 15A:
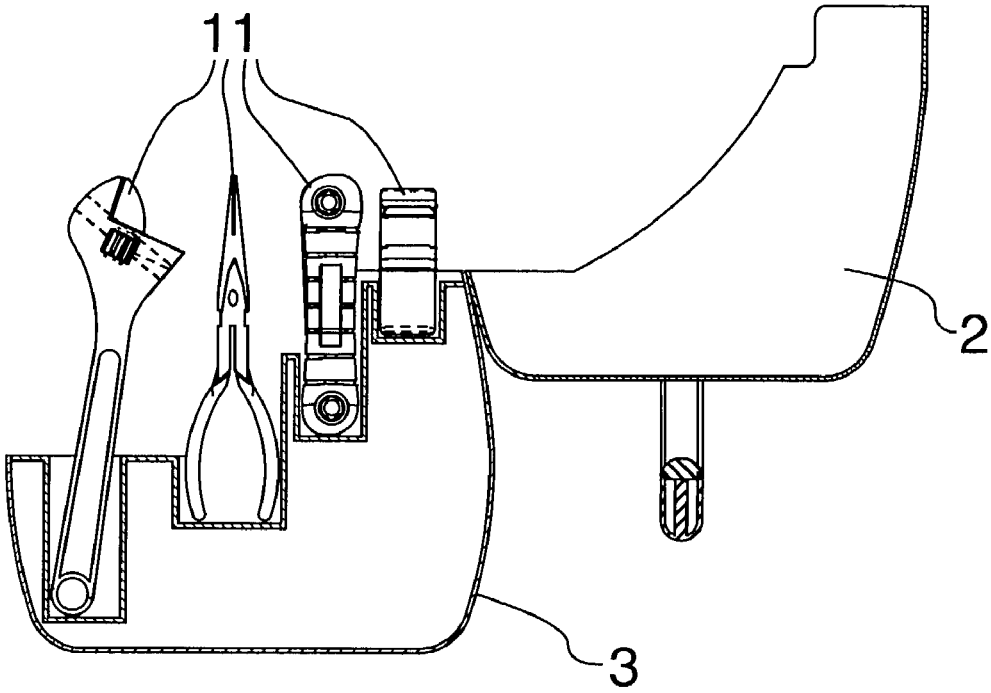
FIG. 15A is a sectional side view of a fifteenth embodiment, with the lid open.
Figure 15B:
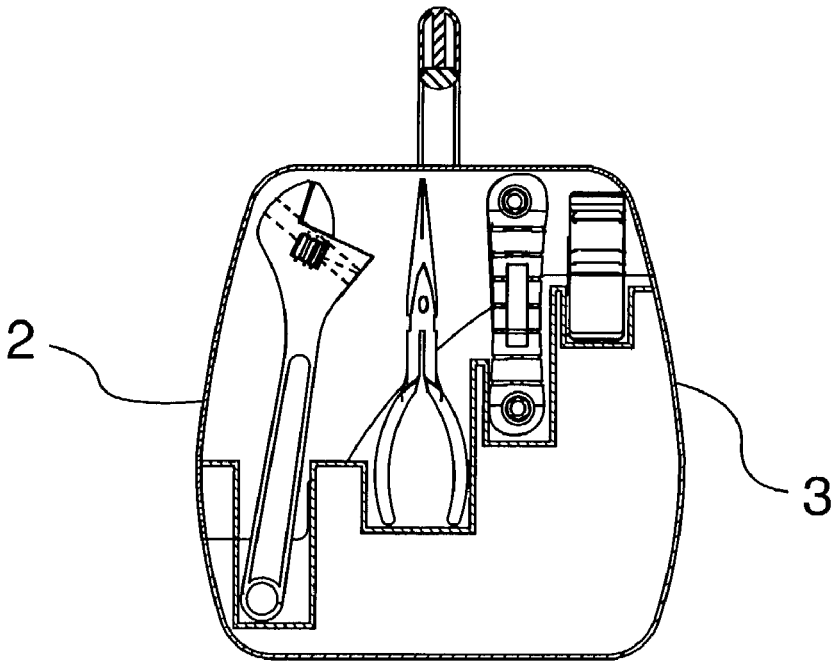
FIG. 15B is a sectional side view corresponding to FIG. 15A, with the lid closed.

FIGS. 15A and 15B show a fifteenth embodiment. In this embodiment, tools 11 of varying sizes may be mounted in the case, in recesses whose depths are selected relative to the sizes of the tools such that the lid 2 when closed contacts or comes close to contacting the tools, such that there is no room for them to fall out of their respective recesses. In this case in particular, but also in others as applicable, it is particularly advantageous to use a stepped approach in arranging the tools, in combination with a transparent lid, to maximize visibility of the tools. Thus, longer tools preferably will be at the front of the case, and shorter tools at the back of the case, as can be seen clearly from FIGS. 15A and 15B. This arrangement provides the consumer with excellent visibility of the tools, secure storage for same, and easy access for same whenever required.

Figure 16A:
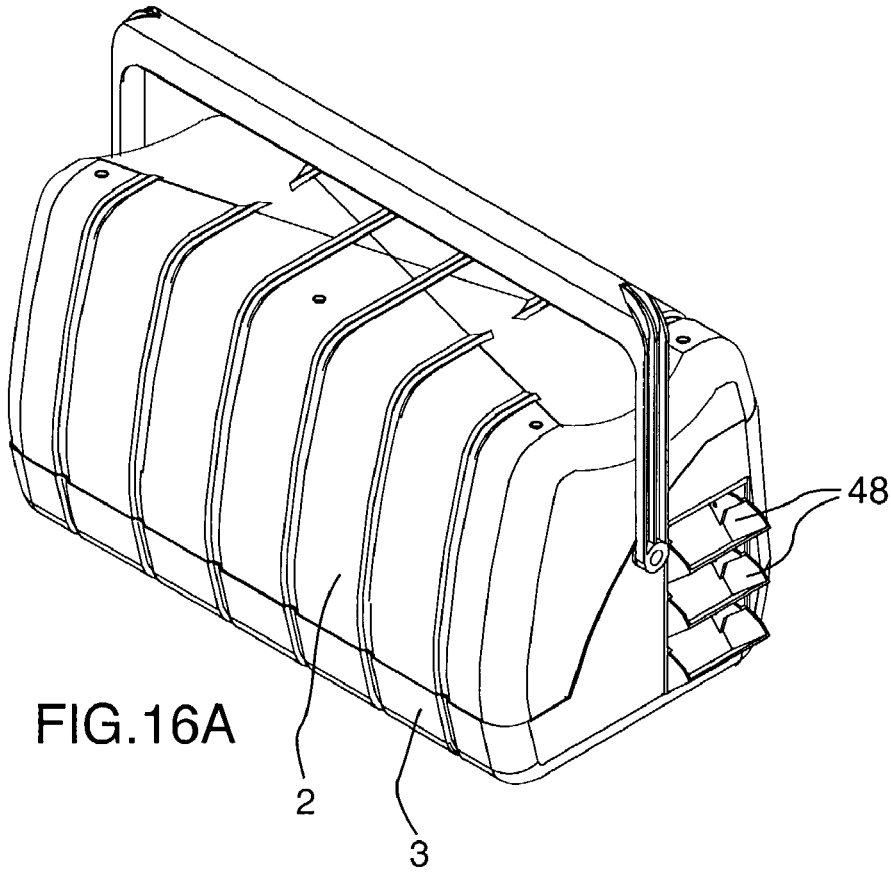
FIG. 16A is a perspective view of a variation of the fifteenth embodiment.
Figure 16B:
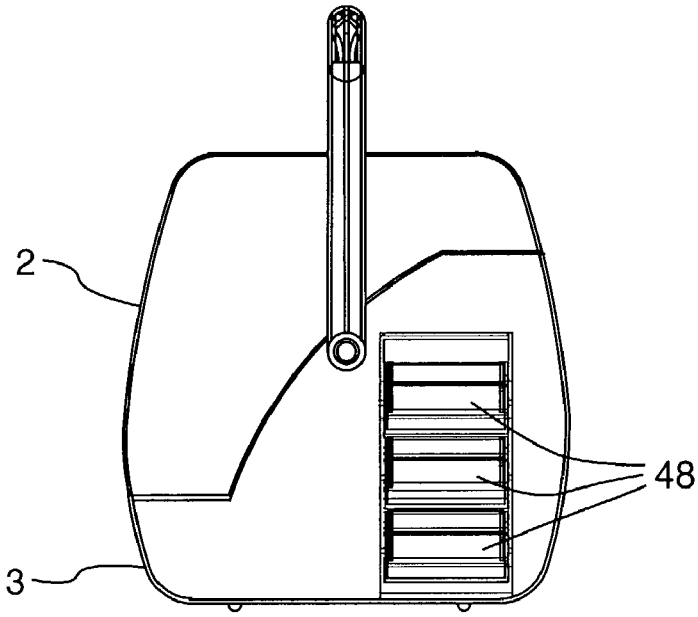
FIG. 16B is a side view corresponding to FIG. 16A.
Figure 16C:
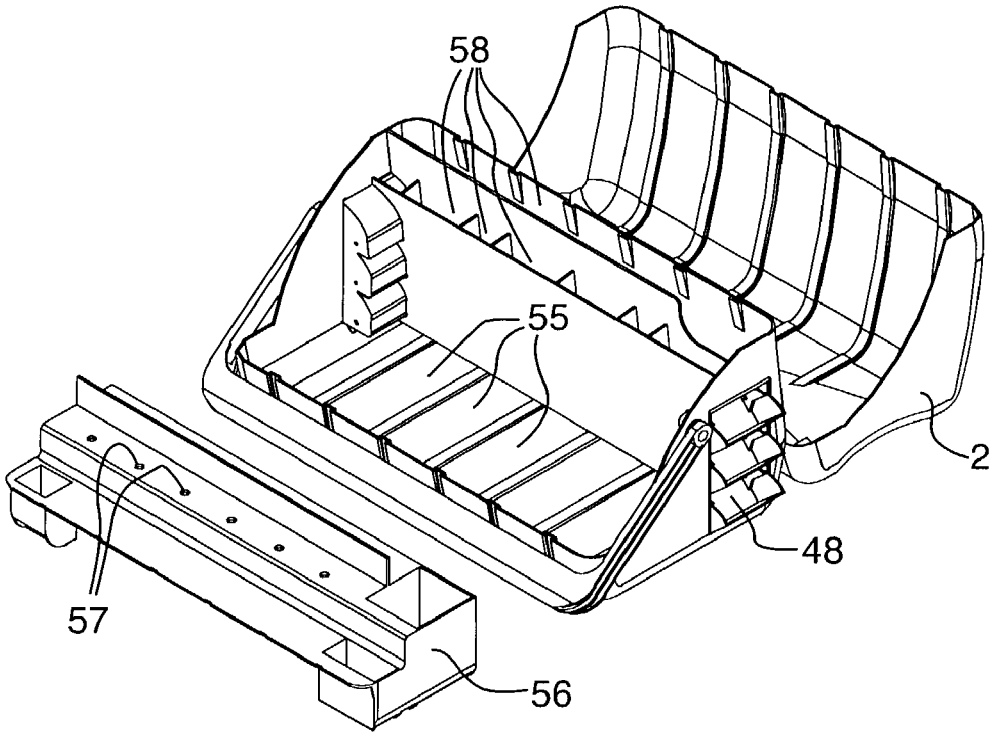
FIG. 16C is an exploded perspective view of the FIG. 16A case.
Figure 16D:
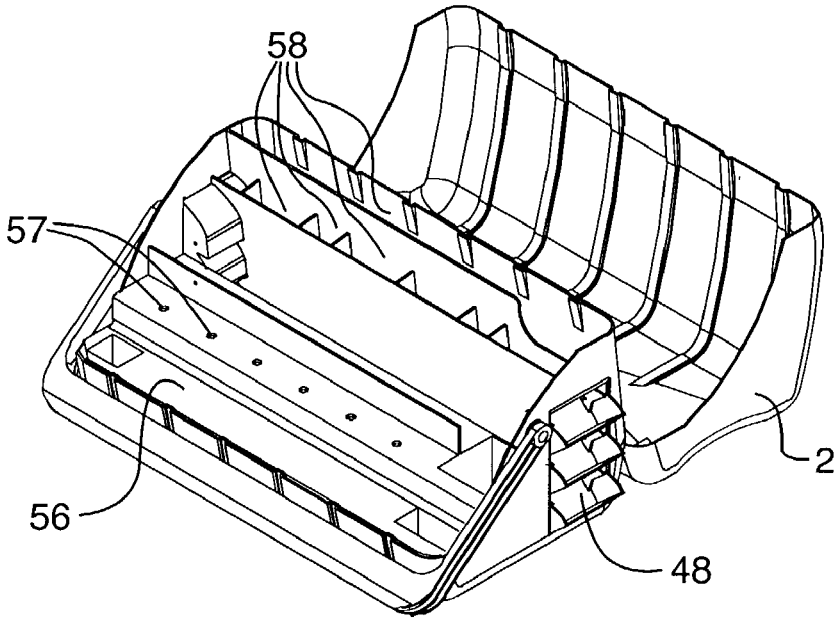
FIG. 16D is an assembled perspective view of the FIG. 16A case.
Figure 16E:
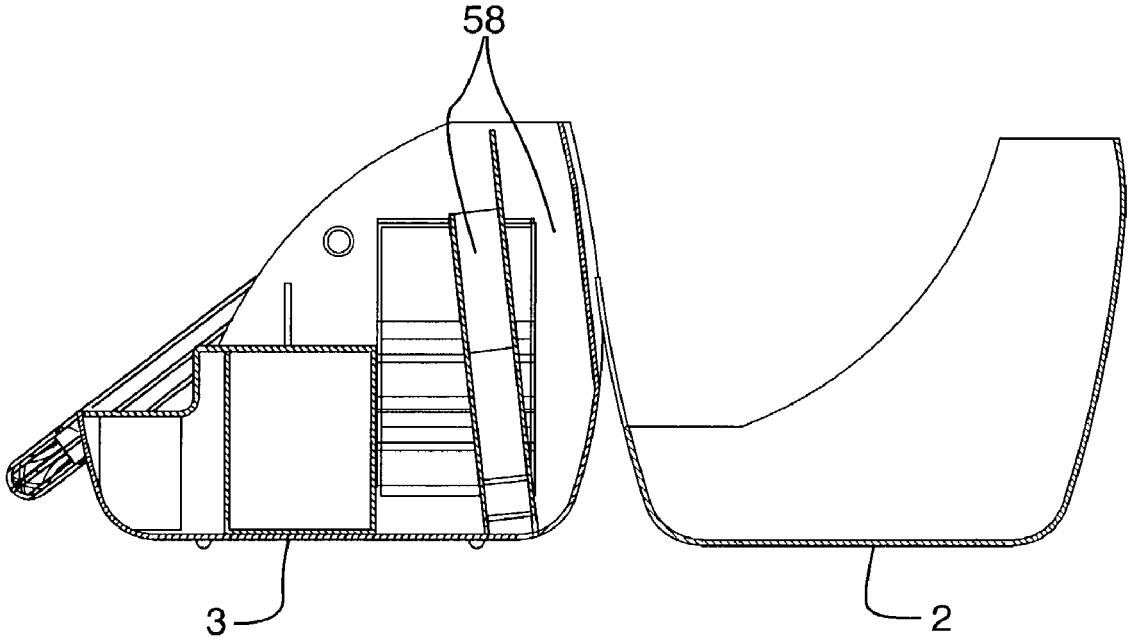
FIG. 16E is a sectional side view of the FIG. 16A case.

FIGS. 16A-16E show a variation of the fifteenth embodiment, in which the case has a plurality of externally-mounted pivotable bins 48, in which components are trapped when the bins are rotated to a closed position. FIGS. 16C, 16D and 16E show a variation in which there are a number of divided compartments 55, and a tray 56 which sits over the divided compartments, nesting with same and into end compartments thereof in particular. The tray then traps any items which are in the divided compartments. The tray itself has means for holding tools, such as holes 57 which can accommodate screwdrivers, for example. Preferably, as in FIGS. 15A and 15B, sizing will be adjusted so that the lid 2 when closed is close to the upper end of the screwdriver handles, so that they are trapped in the case. If desired, the case may also be provided with a number of divided compartments 58 along the back wall of the case.

Figure 17A:
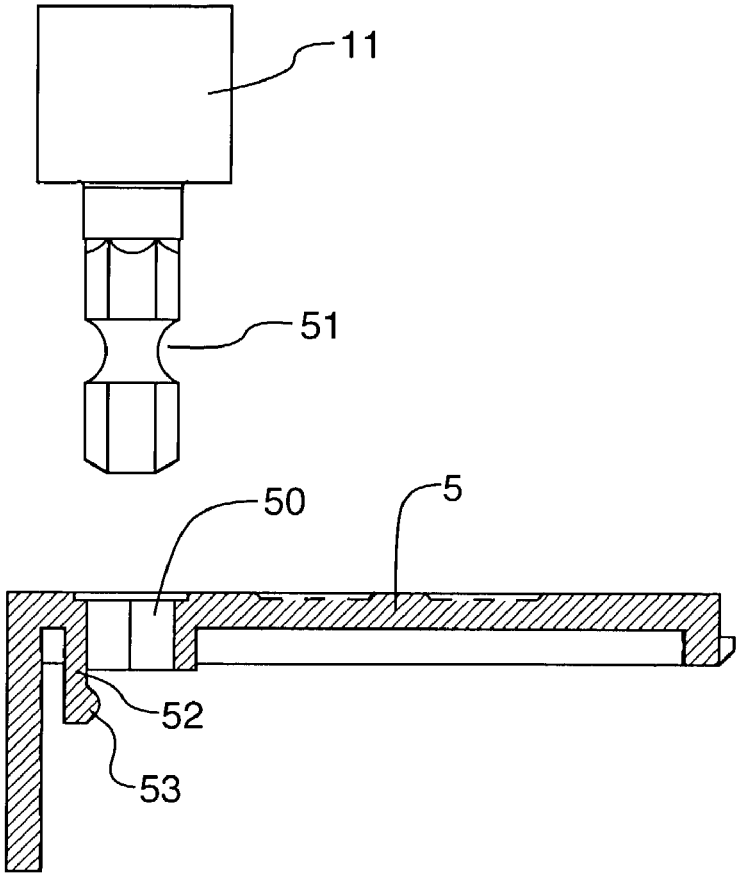
FIG. 17A is an exploded sectional elevation of a retention feature for hex bits.
Figure 17B:
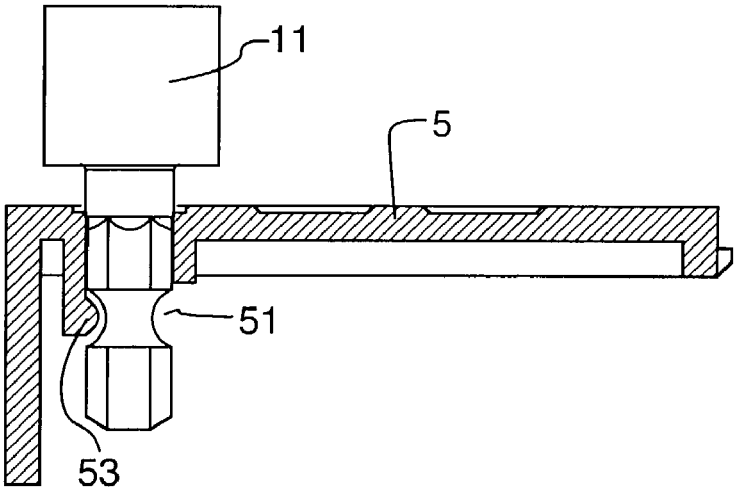
FIG. 17B is a view corresponding to FIG. 17A, with the hex bit installed.

FIGS. 17A and 17B show a retention feature for hex bits, which may be used in virtually any of the cases described above as a convenient way of securely retaining the bits 11 while at the same time providing easy access. The panel 5 is provided with a number of recesses 50 into which the bits fit. Each bit typically has an annular groove 51. The panel is provided with a resilient rail 52 extending along just underneath the panel, preferably as an integral part thereof, the rail having a ridge 53 configured to cooperate with the grooves 51 of the bits, to prevent the bits from falling out. However, sufficient resilience is provided so that the bits can be extracted with a minimal amount of force when needed.

The invention claimed is:

1. A tool case having a base and a lid securable thereto to define a storage space between said base and said lid, said tool case comprising:

at least one panel in said base having means for holding items selected from the group consisting of tool, tool components and hardware; and easy-access means for securing said items in said tool case in a storage position and for facilitating simple removal of said items when desired, said items being retained by clips, a free end of said items having clearance provided beneath said free end, whereby said free end of said items may be pushed downwardly to cause rotation of said items about a fulcrum point, such that after said item is pushed downward, said item is angled with respect to said storage position to slide out from said clips, to remove said items from said clips;

said easy access means further comprising a bridge, located over the items, for securing said items in said tool case, independent of said lid.

2. A tool case as recited in claim 1, said easy-access means comprising end stops arranged to prevent items held in the case from sliding, the item being placed on the panel and held in place by a combination of said clip and said bridge, the bridge being used to align the item during insertion onto the panel, depressions are arranged in the panel beneath one end of the items, whereby to remove an item, the one end is pushed down into the depression to elevate an opposite end of the item, freeing it from the clip but still restrained by the bridge.

3. A tool case as recited in claim 1, wherein the panel has at least one recess in which one end of an item can be pressed down to free the other end from a clip and elevating the item for easy removal, the recess having a sloping floor, and where finger access depressions are provided in the panel for ease of removal of the items.

4. A tool case as recited in claim 1, wherein the panel has at least one raised area on which items are mounted, and at least one recess adjacent one end of the items in which one end of the items can be pressed down to free the other end from a clip and elevating the item for easy removal, the recess having a sloping floor, and where finger access depressions are provided in the panel for ease of removal of the items.

5. A tool case as recited in claim 1, wherein items are held by clips on angled surfaces of the panel, and an end clip holds a notch of the items to prevent longitudinal movement of the items, and the clip holds the body of the items, so that because of the angular position, finger access to the underside of the items is facilitated and removal made easier.

6. A tool case as recited in claim 1, wherein items are arranged step-wise within said case such that longer items are at the front of the case, and shorter items are towards the back of the case, the panel being stepped upwardly from front to rear accordingly to provide different heights such that the shorter items remain visible.

7. A tool case as recited in claim 1 wherein said fulcrum point is located away from said clips.

8. A tool case as recited in claim 7 wherein said fulcrum point is located on said panel.

9. A tool case as recited in claim 1 wherein said items are retained by individual clips.

* * * * *